US006576110B2

(12) United States Patent
Maydan

(10) Patent No.: US 6,576,110 B2
(45) Date of Patent: Jun. 10, 2003

(54) COATED ANODE APPARATUS AND ASSOCIATED METHOD

(75) Inventor: Dan Maydan, Los Altos Hills, CA (US)

(73) Assignee: Applied Materials, Inc., Santa Clara, CA (US)

( * ) Notice: Subject to any disclaimer, the term of this patent is extended or adjusted under 35 U.S.C. 154(b) by 97 days.

(21) Appl. No.: 09/797,040

(22) Filed: Feb. 28, 2001

(65) Prior Publication Data

US 2002/0029973 A1 Mar. 14, 2002

Related U.S. Application Data

(60) Provisional application No. 60/216,693, filed on Jul. 7, 2000.

(51) Int. Cl.[7] ..... C25D 5/00

(52) U.S. Cl. ..... 205/89; 205/102; 205/147; 205/149; 205/150; 205/261; 205/272; 205/284; 205/292; 204/224 R; 204/232; 204/238; 204/240; 204/252; 204/278.5; 204/280; 204/282; 204/283; 204/284; 204/242

(58) Field of Search ..... 205/89, 102, 147, 205/149, 150, 261, 292, 272, 284; 204/224 R, 232, 238, 240, 242, 252, 278.5, 280, 282, 283, 284

(56) References Cited

U.S. PATENT DOCUMENTS

| | | | |
|---|---|---|---|
| 1,599,284 A | 9/1926 | Proctor | |
| 2,742,413 A | 4/1956 | Cransberg et al. | 204/52 |
| 2,882,209 A | 4/1959 | Brown et al. | 204/52 |
| 3,649,509 A | 3/1972 | Morawetz et al. | 204/238 |
| 3,727,620 A | 4/1973 | Orr | 134/95 |
| 3,770,598 A | 11/1973 | Creutz | 204/52 R |
| 4,027,686 A | 6/1977 | Shortes et al. | 134/95 |
| 4,092,176 A | 5/1978 | Kozai et al. | 134/186 |
| 4,110,176 A | 8/1978 | Creutz | 204/52 R |
| 4,113,492 A | 9/1978 | Sato et al. | 96/67 |

(List continued on next page.)

FOREIGN PATENT DOCUMENTS

| | | |
|---|---|---|
| DE | 932 709 | 3/1955 |
| DE | 36 25 475 | 2/1988 |
| EP | 0 307 161 | 3/1989 |
| JP | 58182823 | 10/1983 |
| JP | 63118093 | 5/1988 |

(List continued on next page.)

OTHER PUBLICATIONS

European Search Report from EP 01 11 6055, Dated Oct. 25, 2001.

"Wafer Back Surface Film Removal", Colombo, L., Central R&D, SGS–Thomson Microelectronics, Agrate, Italy, 6 Pages, No month/year available.

(List continued on next page.)

*Primary Examiner*—Bruce F. Bell
(74) *Attorney, Agent, or Firm*—Moser, Patterson & Sheridan

(57) ABSTRACT

An anode is configured to be used within a metal film plating apparatus. The anode has a substantially planar electric field generating portion and an electrolyte solution chemical reaction portion. The planar electric field generating portion is coated with an inert material that is impervious to the electrolyte solution. In one embodiment, the anode is formed as a perforated anode. In one aspect, the electric field generating portion is formed contiguous with the electrolyte solution chemical reaction portion. In another aspects, the planar electric field generating portion is formed as a distinct member from the electrolyte solution chemical reaction portion.

27 Claims, 18 Drawing Sheets

U.S. PATENT DOCUMENTS

| | | | | |
|---|---|---|---|---|
| 4,315,059 | A | 2/1982 | Raistrick et al. | 429/112 |
| 4,326,940 | A | 4/1982 | Eckles et al. | 204/232 |
| 4,336,114 | A | 6/1982 | Mayer et al. | 204/52 R |
| 4,376,685 | A | 3/1983 | Watson | 204/52 R |
| 4,405,416 | A | 9/1983 | Raistrick et al. | 204/68 |
| 4,428,815 | A | 1/1984 | Powell et al. | 204/297 |
| 4,435,266 | A | 3/1984 | Johnston | 204/276 |
| 4,489,740 | A | 12/1984 | Rattan et al. | 134/140 |
| 4,510,176 | A | 4/1985 | Cuthbert et al. | 427/82 |
| 4,514,266 | A | 4/1985 | Cole et al. | 204/28 |
| 4,518,678 | A | 5/1985 | Allen | 430/311 |
| 4,519,846 | A | 5/1985 | Aigo | 134/15 |
| 4,693,805 | A | 9/1987 | Quazi | 204/192.22 |
| 4,732,785 | A | 3/1988 | Brewer | 427/240 |
| 4,789,445 | A | 12/1988 | Goffman et al. | 204/114 |
| 4,906,346 | A | 3/1990 | Hadersbeck et al. | 204/238 |
| 5,039,381 | A | 8/1991 | Mullarkey | 204/47.5 |
| 5,055,425 | A | 10/1991 | Leibovitz et al. | 437/195 |
| 5,092,975 | A | 3/1992 | Yamamura et al. | 204/198 |
| 5,155,336 | A | 10/1992 | Gronet et al. | 219/411 |
| 5,162,260 | A | 11/1992 | Leibovitz et al. | 437/195 |
| 5,222,310 | A | 6/1993 | Thompson et al. | 34/202 |
| 5,224,504 | A | 7/1993 | Thompson et al. | 134/155 |
| 5,230,743 | A | 7/1993 | Thompson et al. | 134/32 |
| 5,252,807 | A | 10/1993 | Chizinsky | 219/390 |
| 5,256,274 | A | 10/1993 | Poris | 205/123 |
| 5,259,407 | A | 11/1993 | Tuchida et al. | 134/151 |
| 5,290,361 | A | 3/1994 | Hayashida et al. | 134/2 |
| 5,316,974 | A | 5/1994 | Crank | 437/190 |
| 5,328,589 | A | 7/1994 | Martin | 205/296 |
| 5,349,978 | A | 9/1994 | Sago et al. | 134/153 |
| 5,368,711 | A | 11/1994 | Poris | 204/193 |
| 5,377,708 | A | 1/1995 | Bergman et al. | 134/105 |
| 5,415,890 | A | 5/1995 | Kloiber et al. | 427/242 |
| 5,429,733 | A | 7/1995 | Ishida | 204/224 R |
| 5,443,707 | A * | 8/1995 | Mori | 204/242 |
| 5,447,615 | A | 9/1995 | Ishida | 204/224 R |
| 5,454,930 | A | 10/1995 | Miura et al. | 205/159 |
| 5,516,412 | A | 5/1996 | Andrlcacos et al. | 204/224 R |
| 5,528,118 | A | 6/1996 | Lee | 318/568.17 |
| 5,608,943 | A | 3/1997 | Konishi et al. | 15/302 |
| 5,625,170 | A | 4/1997 | Poris | 177/50 |
| 5,651,865 | A | 7/1997 | Sellers | 204/192.13 |
| 5,705,223 | A | 1/1998 | Bunkofske | 427/240 |
| 5,718,813 | A | 2/1998 | Drummond et al. | 204/192.12 |
| 5,723,028 | A | 3/1998 | Poris | 204/231 |
| 5,730,890 | A | 3/1998 | Bickford et al. | 216/87 |
| 5,838,121 | A | 11/1998 | Fairbairn et al. | 318/45 |
| 6,024,856 | A | 2/2000 | Haydu et al. | 205/84 |
| 6,071,388 | A | 6/2000 | Uzoh | 204/297 R |
| 6,093,291 | A | 7/2000 | Izumi et al. | 204/224 R |
| 6,113,771 | A | 9/2000 | Landau et al. | 205/123 |
| 6,254,760 | B1 | 7/2001 | Shen et al. | 205/335 |
| 6,258,220 | B1 | 7/2001 | Dordi et al. | 204/198 |
| 6,261,433 | B1 | 7/2001 | Landau | 205/96 |
| 6,267,853 | B1 | 7/2001 | Dordi et al. | 204/232 |
| 6,350,366 | B1 | 2/2002 | Landau et al. | 205/182 |

FOREIGN PATENT DOCUMENTS

| | | |
|---|---|---|
| JP | 04131395 | 5/1992 |
| JP | 04280993 | 10/1992 |
| JP | 06017291 | 1/1994 |
| JP | 2000256891 | 9/2000 |
| SU | 443 108 | 12/1974 |
| WO | 97/12079 | 4/1997 |
| WO | 99/25902 | 5/1999 |
| WO | 99/25903 | 5/1999 |
| WO | 99/25904 | 5/1999 |
| WO | 99/25905 | 5/1999 |
| WO | 99/26275 | 5/1999 |
| WO | WO 00/32835 | 6/2000 |

OTHER PUBLICATIONS

"Metallization & Interconnect", SEMITOOL Products/Sales, Oct. 27, 1998, 4 pages.

Laurel Technologies Corporation, Oct. 27, 1998, 6 pages.

"VERTEQ" VERTEQ Online, 5 pages, No month/year available.

"Tantalum, Copper and Damascene: The Future of Interconnects", Singer, P., Semiconductor International, Jun. 1998, 6 pages, "Wafer Processing", Singer, P., Semiconductor International, Jun. 1998, p. 70.

"Ney Contact Manual", Pitney, K., Electrical Contacts for Low Energy Uses, Oct. 8, 1974, 19 pages.

"Electric Contacts Theory and Application", Holm, R., Springer–Verlag New York Inc, 1967, 27 pages, No month available.

U.S. patent application Ser. No. 09/658,336, Hey et al., filed Sep. 8, 2000.

U.S. patent application Ser. No. 09/663,814, Olgado et al., filed Sep. 15, 2000.

U.S. patent application Ser. No. 09/664,607, Olgado et al., filed Sep. 18, 2000.

U.S. patent application Ser. No. 09/676,362, Olgado et al., filed Sep. 29, 2000.

U.S. patent application Ser. No. 09/678,947, Dordi et al., filed Oct. 3, 2000.

U.S. patent application Ser. No. 09/687/053, Hey et al., filed Oct. 2000.

U.S. patent application Ser. No. 09/684,500, Olgado et al., filed Oct. 6, 2000.

U.S. patent application Ser. No. 09/731,326, Dordi et al., filed Dec. 5, 2000.

U.S. patent application Ser. No. 09/766,060, Hey et al., filed Jan. 18, 2001.

* cited by examiner

COATED ANODE APPARATUS AND ASSOCIATED METHOD

This disclosure claims priority to commonly assigned U.S. provisional patent application, serial no. 60/216,693, filed on Jul. 7, 2000, entitled "COATED ANODE APPARATUS FOR REDUCING PARTICLE GENERATION" (incorporated herein by reference).

BACKGROUND OF THE DISCLOSURE

1. Field of the Invention

The invention relates to metal film deposition. More particularly, the invention relates to anodes used in metal film deposition.

2. Description of the Prior Art

Electro-chemical plating (ECP), previously limited in integrated circuit design to the fabrication of lines on circuit boards, is now used to fill features in substrates such as vias and contacts. ECP, in general, can be utilized with a variety of processes. One process including ECP comprises depositing a barrier diffusion layer over the feature surfaces of the wafer by a process such as chemical vapor deposition (CVD) or physical vapor deposition (PVD). A conductive metal seed layer is then deposited over the barrier diffusion layer by a process such as PVD or CVD. A conductive metal film (e.g. copper) is then deposited on the seed layer by ECP to fill the structure/feature. Finally, the deposited metal film is planarized by a process such as chemical mechanical polishing (CMP), to define a conductive interconnect feature.

Deposition of a metal film on a seed layer during electroplating is accomplished by electric voltage biasing the seed layer on a substrate relative to an anode. During ECP processing, both the seed layer and the anode are contained in electrolyte solution in an electrolyte cell. The seed layer is electrically biased to attract metal ions within the electrolyte solution to be deposited on the seed layer.

Those anode surfaces that are exposed to electrolyte solution typically chemically react with the electrolyte solution, and eventually degrade. Particulate matter from degraded anodes may also be dispersed into the electrolyte solution. If the particulate matter contacts the seed layer, the seed layer can become physically distorted, chemically) altered, and generally contain irregularities. Such irregularities can effect the electrical characteristics (such as electric current density) of the seed layer.

In ECP systems an electric field is established between an anode and a seed layer on a substrate during the metal film deposition. To enhance the metal film deposition on the seed layer, an electrolyte solution fluid flow is established, for example, from below the anode, through or around the anode, towards the substrate. The chemical reaction between the anode and the electrolyte solution is enhanced by the addition of electricity applied to the anode. This enhanced chemical reaction supplies metal ions into the electrolyte solution from the metal forming the anode. The combination of the electric field established from the anode to the seed layer on the substrate in combination with the fluid flow in the electrolyte cell, acts to transport metal ions from the anode toward the seed layer on the substrate. Generation of metal ions by the anode into the electrolyte solution, in addition to the formation of such particulate byproducts as anode sludge, acts to degrade the surface of the anode. After a certain period, this degradation of the metal surface of the metal of the anode produces an uneven upper anode surface.

During the ECP process, it is desired to maintain the anode surface facing the substrate in a planar configuration, with the face of the plane oriented substantially parallel to the seed layer. Any anode surface deviation from being planar results in a variation of spacing between different points on the upper surface of the anode from the nearest locations on the seed layer. The electric resistance of any point on the anode to the nearest seed layer point via the electrolyte solution varies as a function of distance through the electrolyte solution. A shorter distance between any particular location on the upper surface of the anode to its nearest location on the seed layer through the electrolyte Solution typically results in a decreased electrical resistance between the anode surface location to the seed layer surface because electrolyte solution resistance varying as a function of Ohms law.

Since establishing, a substantially uniform electric current density across the surface of the seed layer on the substrate enhances the uniformity of metal film deposition across the seed layer, a variation of the resistances between the various anode surface locations and the seed layer results in a variation of the electric current density across the seed layer on the substrate. Such variations in the electric current density across the seed layer results in variations in metal film deposition across the surface of the substrate. In the metal film deposition process, it is desired to maintain the metal film deposition across the surface of the seed layer as uniform as possible to provide uniform electrical characteristics of the metal film following the metal film deposition. It thus becomes difficult to maintain seed layer plating on the substrate when the upper surface of the anode assumes an irregular, non planar, configuration as a result of the chemical reaction between the upper surface of the anode and the electrolyte solution as often occurs with extended anode use.

Therefore, it is desired to provide a system by which those portions of the anode that face a substrate, immersed in the electrolyte solution, are maintained substantially planar even following extended use in a configuration to enhance the resultant uniformity of the electric current density across the seed layer. Such electric current density enhancement also enhances uniformity of the metal film deposition rate across the seed layer.

SUMMARY OF THE INVENTION

This invention generally relates to an anode configured to be used within a metal film plating apparatus. The anode has a substantially planar electric field generating portion and an electrolyte solution chemical reaction portion. The planar electric field generating portion is coated with an inert material that is impervious to the electrolyte solution. In one embodiment, the anode is formed as a perforated anode. In one aspect, the planar electric field generating portion is formed contiguous with the electrolyte solution chemical reaction portion. In another aspects, the planar electric field generating portion is formed as a distinct member from the electrolyte solution chemical reaction portion.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will clearly realize that the teachings of the invention can be readily utilized in metal film deposition applications.

Figure 1:
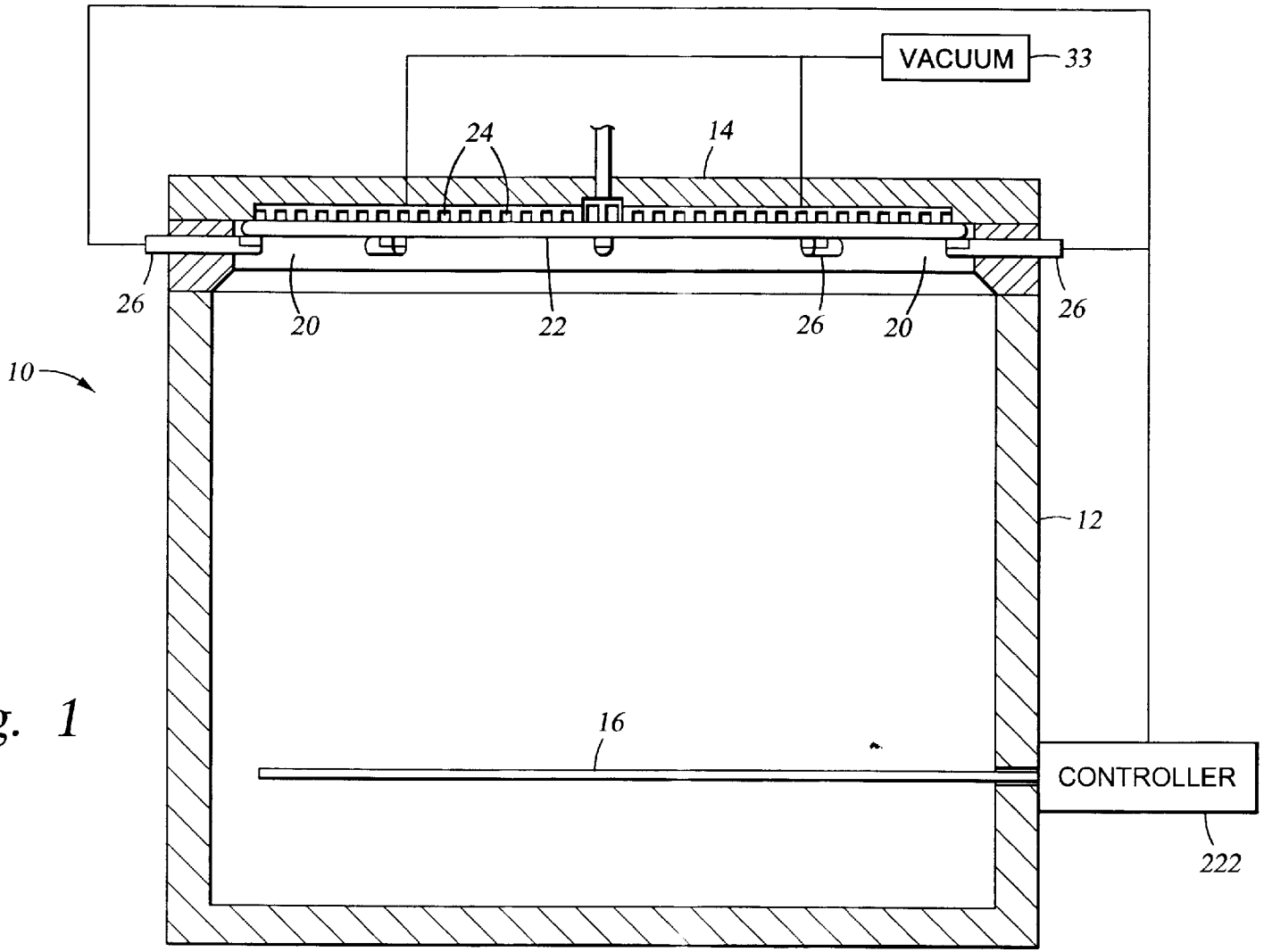
FIG. 1 is a cross sectional view of one embodiment of electrochemical plating (ECP) system.
Figure 2:
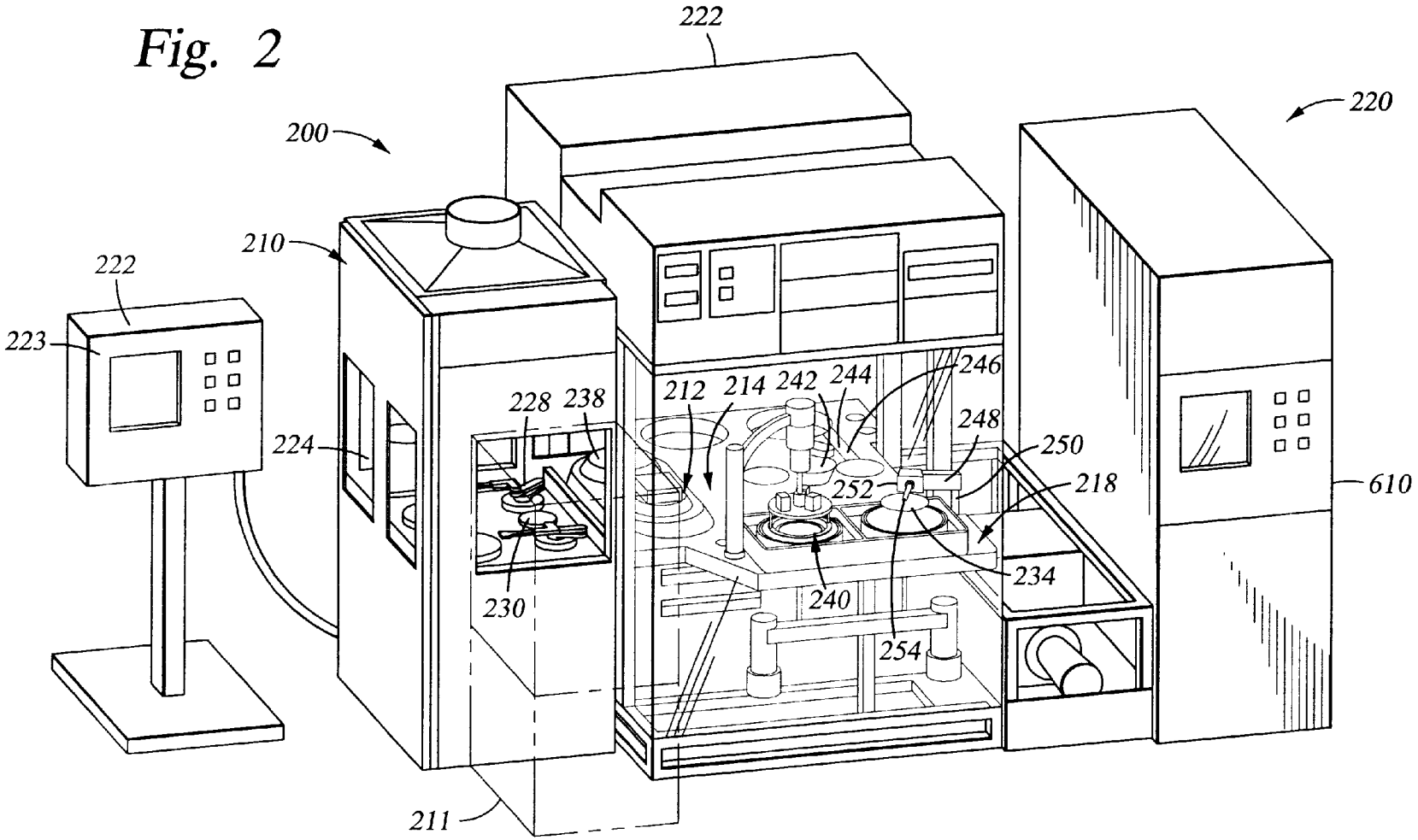
FIG. 2 is a perspective view of another embodiment of ECP system.
Figure 3:
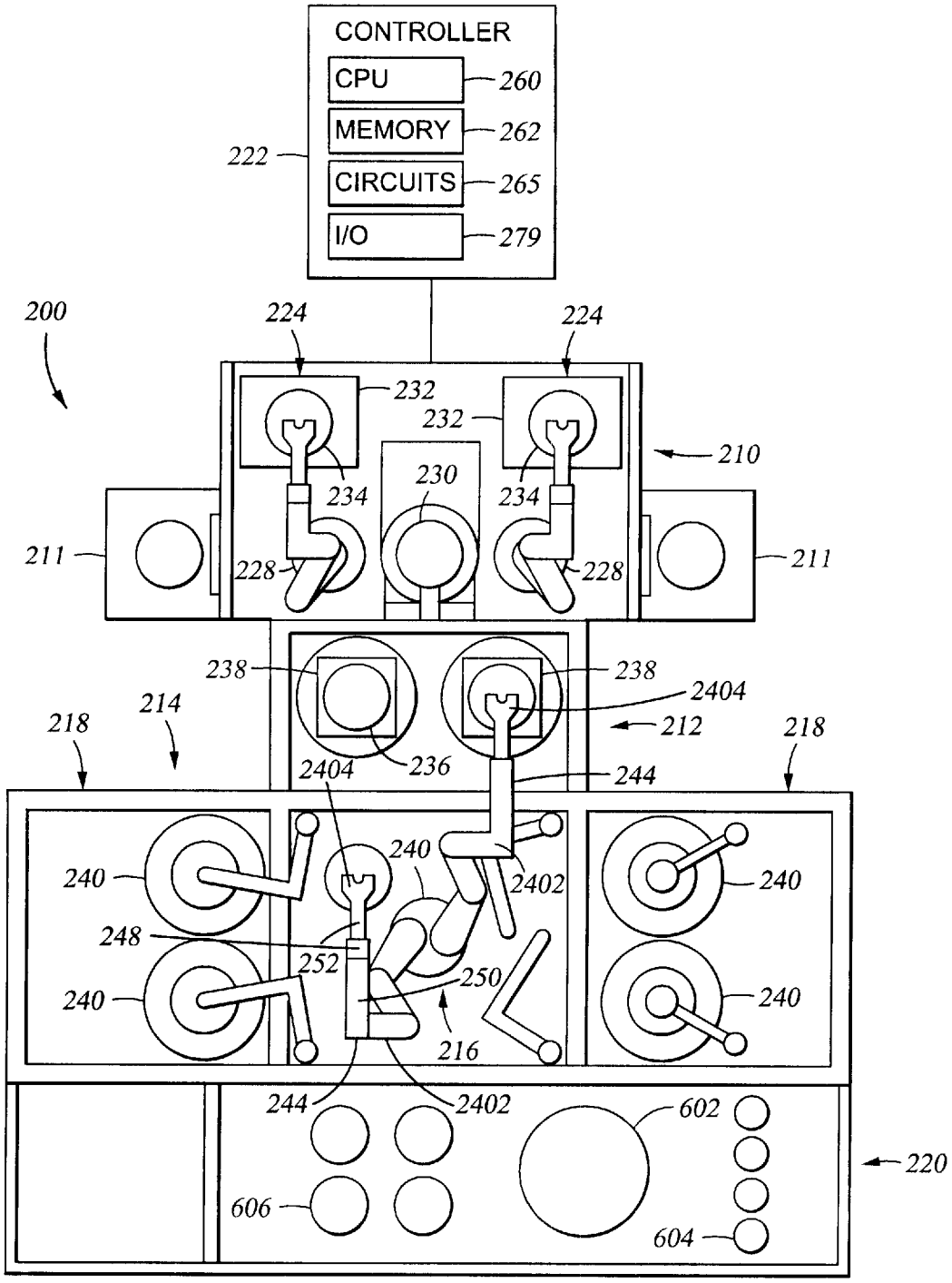
FIG. 3 is a top schematic view of the ECP system of FIG. 2.

In the following description, the structure and operation of multiple embodiments of systems that can perform electro-chemical plating (ECP) is described. FIGS. 1, 2, and 3 show multiple embodiments of ECP systems.

Figure 18:
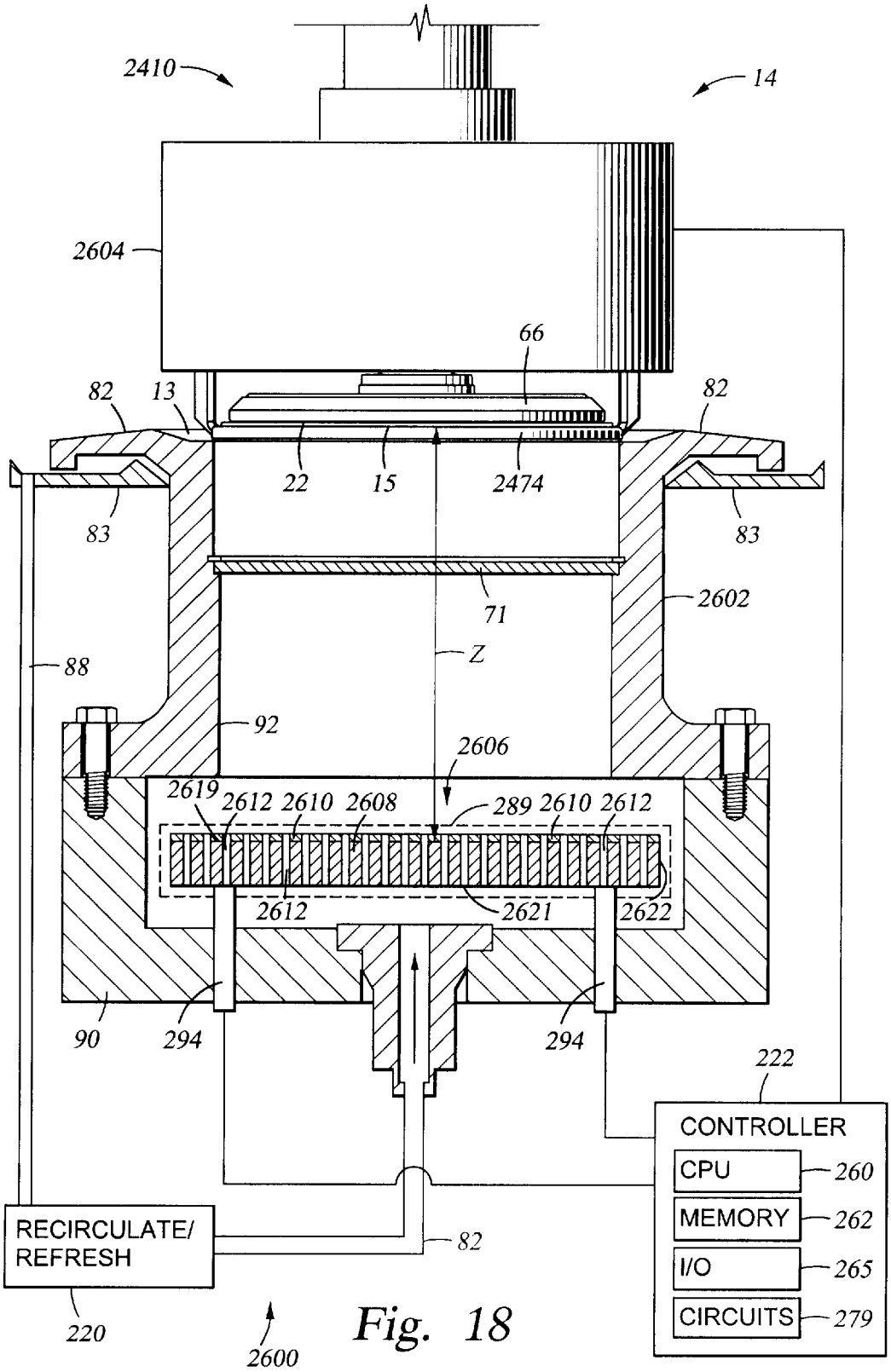
FIG. 18 shows an ECP system including one embodiment of anode.
Figure 19:
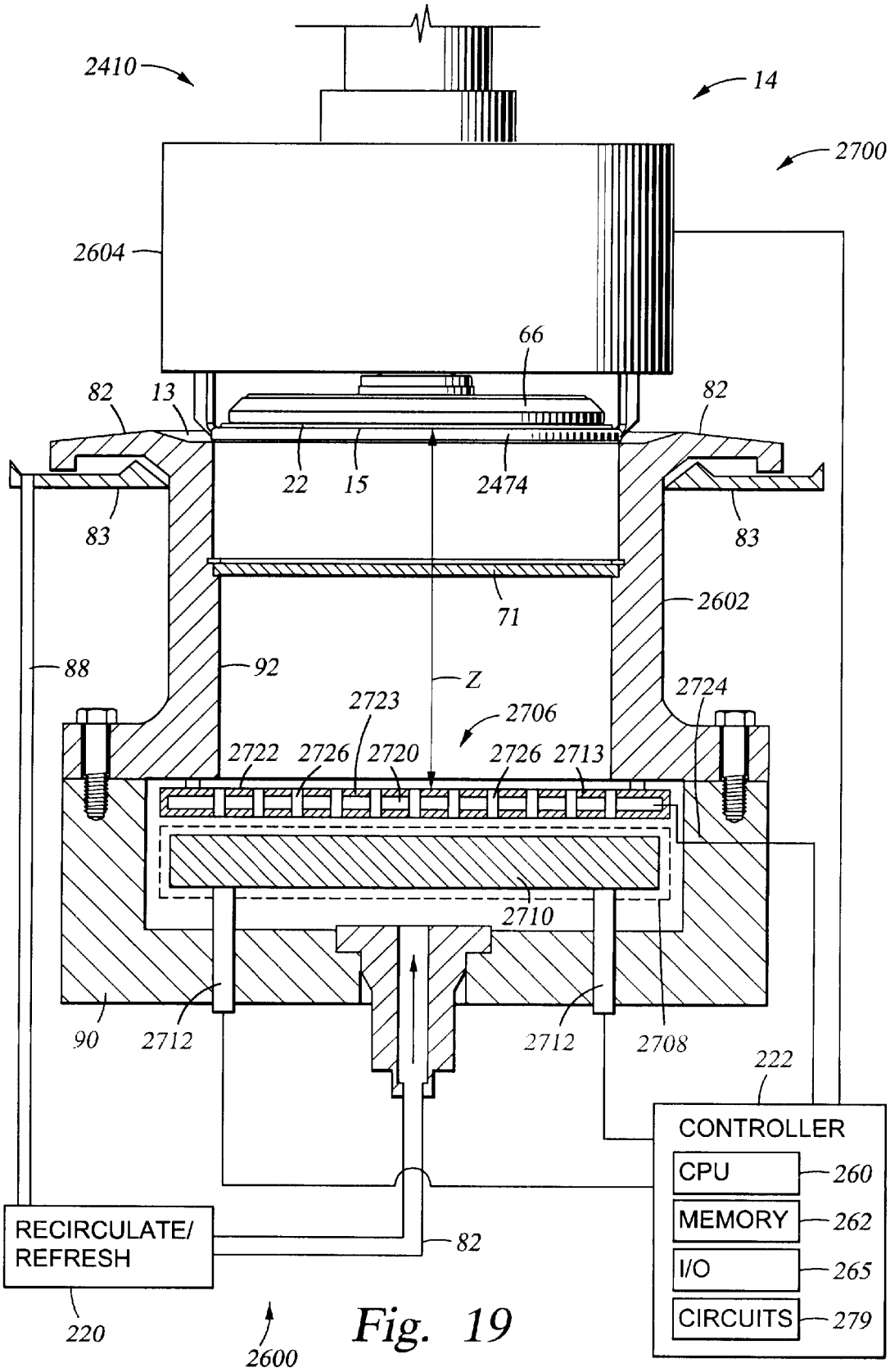
FIG. 19 shows an ECP system including another embodiment of anode.

In one embodiment of ECP systems, such as the embodiments shown in FIGS. 18 and 19, the surface of the anode that faces the substrate is coated with an inert metal. The inert metal limits the chemical reaction that occurs between the surface of the anode and the electrolyte solution. Multiple electroplating system embodiments that include a coated anode ale described.

ECP System

The structure and operation of multiple embodiments of ECP system are now described. FIG. 1 shows one embodiment of ECP system 200 that is used to deposit a metal film on a seed layer formed on a substrate. The ECP system 200 includes an electrolyte cell 12, a substrate holder system 14, an anode 16, and a contact ring 20. The electrolyte cell 12 contains electrolyte solution, and the electrolyte cell has a top opening 21 circumferentially defined by the contact ring 20. The substrate holder system 14 is disposed above the electrolyte cell, and the substrate holder system is capable of immersing the substrate into, and removing the substrate from, the electrolyte solution through the top opening. The substrate holder system 14 is capable of securing and positioning the seed layer on the substrate in a desired position immersed in the electrolyte solution during processing. The contact ring 20 comprises a plurality of metal or metal alloy electrical contact elements that physically electrically contact the substrate seed layer. The electric contact elements may be, e.g., contact pins, contact rods, contact surfaces, contact pads, etc.

FIG. 2 is a perspective view of another embodiment of ECP system 200. FIG. 3 is a top schematic view of the ECP system 200 of FIG. 2. Referring to both FIGS. 2 and 3, the ECP system 200 generally comprises a loading station 210, a rapid thermal anneal (RTA) chamber 211, a spin-rinse-dry (SRD) station 212, a mainframe 214, and an electrolyte solution replenishing system 220. Preferably, the ECP system 200 is enclosed in a clean environment using panels such as made from PLEXIGLAS® (a registered trademark of the Rohm and Haas Company of West Philadelphia, Pa.). The mainframe 214 (generally comprises a mainframe transfer station 216 and a plurality of processing stations 218. Each processing station 2 18 includes one or more process cells 240. An electrolyte solution replenishing system 220 is positioned adjacent the ECP system 200 and is connected to the process cells 240 individually to circulate electrolyte solution used for the electroplating process. The ECP system 200 also includes a controller 222, typically comprising a programmable microprocessor and interacting with a solid-state power supply.

A controller 222 controls the electric current/voltage supplied to the electric contact and to the anode. Typically, the controller 222 is associated with a controllable power supply, such as semi-conductor power source, that supplies the electric current to the electric contact and to the anode. The controller controls the electrical current supplied to the seed layer when the seed layer on the substrate is being plated. The controller 222 thereby determines the electrical current/voltage established from the anode to the seed layer on the substrate.

Figure 4:
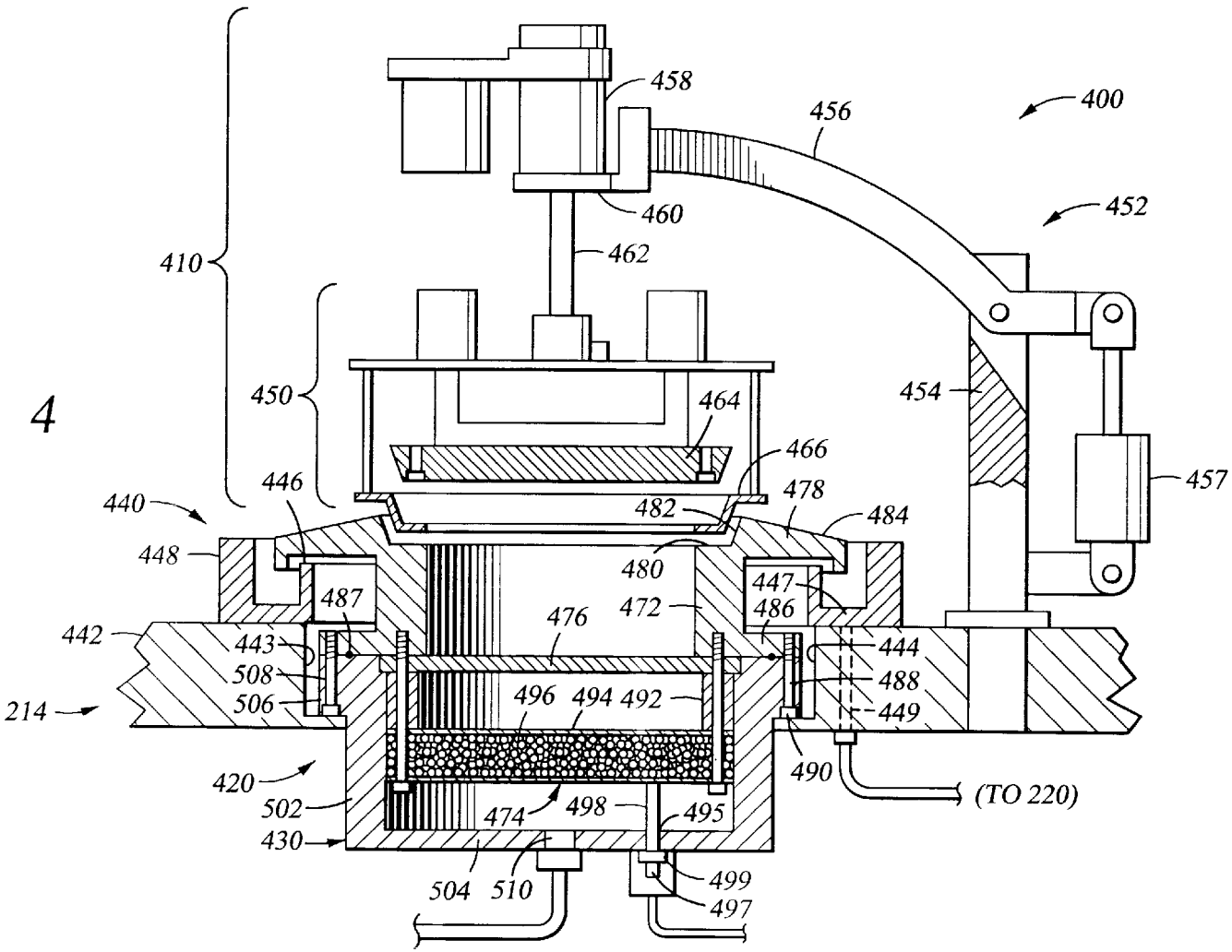
FIG. 4 is a cross sectional view of one embodiment of a process cell used in ECP processing.

The controller 222, whose components are shown in FIG. 3, comprises a central processing unit (CPU) 260, memory 262, circuit portion 265, input output interface (I/O) 279, and bus, not shown. The controller 222 may be a general-purpose computer, a microprocessor, a microcontroller, or any other known suitable type of computer or controller. The CPU 260 performs the processing and arithmetic operations for the controller 222. The controller 222 controls the plating process, robotic operations, timing, etc. associated with the ECP system 200. The controller controls the electric voltage/current applied by a controllable power source (not shown) to both the anode 16 and the plating surface 15 on the substrate 22. The controller also controls the displacement of the substrate holder assembly that is used to immerse the seed layer on the substrate in the electrolyte solution, as shown in FIG. 4.

The memory 262 includes random access memory (RAM) and read only memory (ROM) that together store the computer programs, operands, operators, dimensional values, system processing temperatures and configurations, and other parameters that control the electroplating operation. The bus provides for digital information transmissions between CPU 260, circuit portion 265, memory 262, and I/O 279. The bus also connects I/O 279 to the portions of the ECP system 200 that either receives digital information from, or transmits digital information to, controller 222.

I/O 279 provides an interface to control the transmissions of digital information between each of the components in controller 222. I/O 279 also provides an interface between the components of the controller 222 and different portions of the ECP system 200. Circuit portion 265 comprises all of the other user interface devices, such as display and keyboard.

In this disclosure, the term "substrate" is intended to describe substrates, semiconductor substrates, liquid crystal diode (LCD) displays, or other objects that can be processed within the ECP system 200. The substrates are generally circular or rectangular and may be of any size, though many substrates commonly have a 200 mm or 300 mm diameter. The loading station 210 preferably includes one or more substrate cassette receiving areas 224, one or more loading station transfer robots 228 and at least one substrate orientor 230. The number of substrate cassette receiving areas, loading station transfer robots 228 and substrate orientors included in the loading station 210 can be configured according to the desired throughput of the system. As shown for one embodiment in FIGS. 2 and 3, the loading station 210 includes two substrate cassette-receiving areas 224, two loading station transfer robots 228, one substrate orientor 230, and a substrate cassette 232. The substrate cassette 232 contains one or more substrates 234 in vertically-spaced cassette shelves which provides a location where the substrates can be stored, removed from, or inserted in conjunction with the ECP system. The loading station transfer robot 228 transfers substrates 234 between the substrate cassette 232 and the substrate orientor 230. The loading station transfer robot 228 comprises a typical transfer robot commonly known in the art. The substrate orientor 230 positions each substrate 234 in a desired orientation to ensure that the substrate is properly processed. The loading station transfer robot 228 also transfers substrates 234 between the loading station 210 and the SRD station 212 and between the loading station 210 and the thermal anneal chamber 211.

The SRD stations apply rinsing and/or dissolving fluids to the surface of a substrate to rinse and/or etch undesired deposits or dried chemicals (e.g. in the form of chemical crystals) from the surface of the substrates that have been processed. The SRD system then spins the substrate during the application of the rinsing/etching fluids. The SRD system also spins the substrate (at up to about 2800 RPM in one embodiment) after the rinsing/etching fluid is applied to remove the fluid from the surface of the substrate by centrifugal action applied to the substrate. The operation of the SRD module is not provided in greater detail, but is contained in U.S. patent application Ser. No. 09/289,074, filed Apr. 8, 1999, and entitled "ELECTROCHEMICAL DEPOSITION SYSTEM" (incorporated herein by reference). Other aspects of the ECP system are also provided in this incorporated patent application.

Preferably, the mainframe transfer station 216 includes a flipper robot 248 that facilitates transfer of a substrate from a face-up position on the robot blade 246 (of the mainframe transfer robot 242) to a face down position for a process cell 240 that requires face-down processing of substrates. The flipper robot 248 includes a main body 250 that provides both vertical and rotational movements with respect to a vertical axis of the main body 250 and a flipper robot arm 252 that provides rotational movement along a horizontal axis. Preferably, a vacuum suction gripper 254, disposed at the distal end of the flipper robot arm 252, holds the substrate as the substrate is flipped and transferred by the flipper robot 248. The flipper robot 248 positions a substrate into the process cell 240 for face-down processing. The details of the electrolyte cell will be discussed below.

Figure 14:
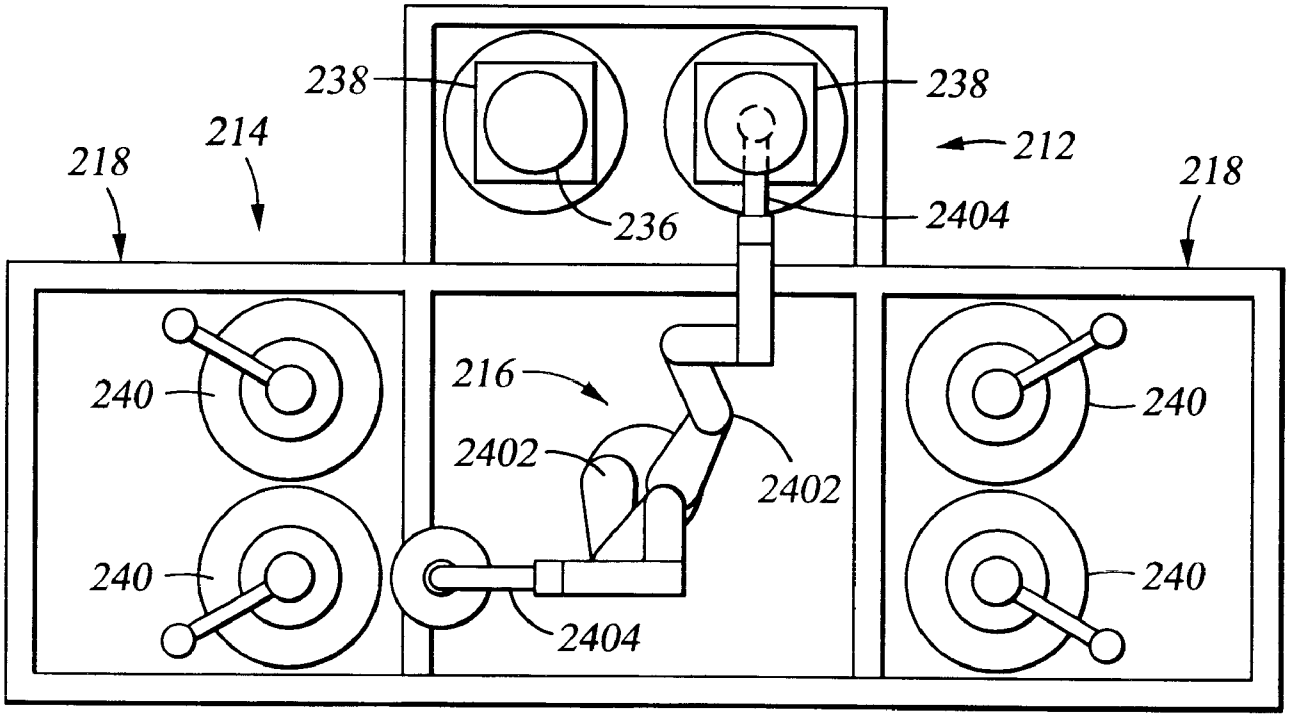
FIG. 14 is a top schematic view of a mainframe having a flipper robot incorporated therein.

FIG. 14 is a top schematic view of a mainframe transfer robot having a flipper robot incorporated therein. The mainframe transfer robot 216 as shown in FIGS. 3 and 14 serves to transfer substrates between different stations attached the mainframe station, including the processing stations and the SRD stations. The mainframe transfer robot 216 includes a plurality of robot arms 2402 (two are shown) and a flipper robot 2404. The flipper robot 2404 is attached at a distal location to an end effector of each of the robot arms 2402. Flipper robots are generally known in the art and can be attached as end effectors for substrate handling robots, such as model RR701, available from RORZE AUTOMATION, INC., located in Milpitas, Calif. The main transfer robot 216 comprising the flipper robots 2404 with end effector is capable of transferring substrates between different stations attached to the mainframe as well as flipping the substrate to the desired surface orientation, i.e., substrate processing surface being face-down for the electroplating process. Preferably, the mainframe transfer robot 216 provides independent robot motion along each of the X-Y-Z axes using the combination of motion within a substantially horizontal plane by the robot arm 2402 and independent substrate flipping rotation using the flipper robot end effector 2404. By incorporating the flipper robot 2404 integrated with the end effector of the mainframe transfer robot, the substrate transfer process is simplified because the step of passing a substrate from a mainframe transfer robot to a flipper robot is eliminated.

FIG. 4 is a cross sectional view of one embodiment of an electroplating process cell 400 of the ECP system of FIGS. 2 and 3. The electroplating process cell 400 generally comprises a head assembly 410, an electrolyte cell 420 and an electrolyte solution collector 440. Preferably, the electrolyte solution collector 440 is secured onto the body 442 of the mainframe 214 over an opening 443 that defines the location for placement of the electrolyte cell 420. The electrolyte solution collector 440 includes an inner wall 446, an outer wall 448 and a bottom 447 connecting the walls. An electrolyte solution outlet 449 is disposed through the bottom 447 of the electrolyte solution collector 440 and connected to the electrolyte solution replenishing system 220 shown in FIG. 2 through tubes, hoses, pipes or other fluid transfer connectors.

The head assembly 410 is mounted onto a head assembly frame 452. The head assembly frame 452 includes a mounting post 454 and a cantilever arm 456. The mounting post 454 is mounted onto the body 442 of the mainframe 214, and the cantilever arm 456 extends laterally from an upper portion of the mounting post 454. Preferably, the mounting post 454 provides rotational movement with respect to a vertical axis along the mounting post to allow rotation of the head assembly 410. The head assembly 410 is attached to a mounting plate 460 disposed at the distal end of the cantilever arm 456. The lower end of the cantilever arm 456 is connected to a cantilever arm actuator 457, such as a pneumatic cylinder, mounted on the mounting post 454. The cantilever arm actuator 457 provides pivotal movement of the cantilever arm 456 with respect to the joint between the cantilever arm 456 and the mounting post 454. When the cantilever arm actuator 457 is retracted, the cantilever arm 456 moves the head assemnbly 410 away from the electrolyte cell 420 to provide the spacing required to remove and/or replace the electrolyte cell 420 from the electroplating process cell 400. When the cantilever arm actuator 457 is extended, the cantilever arm 456 moves the head assembly 410 toward the electrolyte cell 420 to position the substrate in the head assembly 410 in a processing position.

The head assembly 410 generally comprises a substrate holder assembly 450 and a substrate assembly actuator 458. The substrate assembly actuator 458 is mounted onto the mounting plate 460, and includes a head assembly shaft 462 extending downwardly through the mounting plate 460. The lower end of the head assembly shaft 462 is connected to the substrate holder assembly 450 to position the substrate holder assembly 450 in a processing position and in a substrate loading position.

Figure 5:
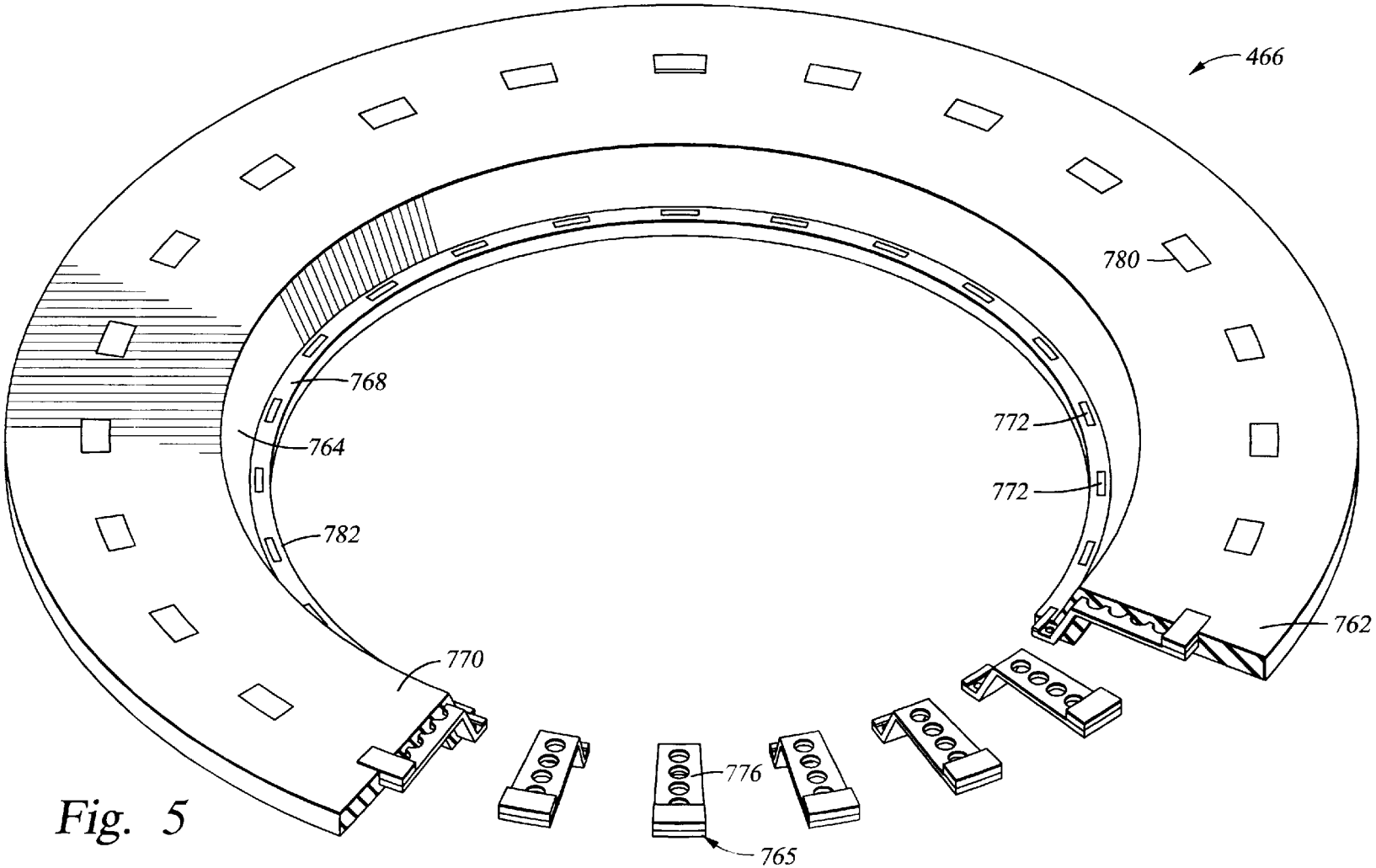
FIG. 5 is a partial cross sectional perspective view of one embodiment of cathode contact ring of FIG. 4.

The substrate holder assembly 450 generally comprises a substrate holder plate 464 and an electric contact clement 466. FIG. 5 is a cross sectional view of one embodiment of a electric contact element 466. In general, the electric contact element 466 comprises an annular body having a plurality of conducting members disposed thereon. The annular body is constructed of an insulating material to electrically isolate the plurality of conducting members. Together the body and conducting members form a diametrically interior substrate seating surface which, during processing, supports a substrate and provides a current thereto.

Referring now to FIG. 5 in detail, the electric contact element 466 generally comprises a plurality of conducting members 765 at least partially disposed within an annular insulative body 770. The insulative body 770 is shown having a flange 762 and a downward sloping shoulder portion 764 leading to a substrate seating surface 768 located below the flange 762. The flange 762 and the substrate seating surface 768 lie in offset and substantially parallel planes. Thus, the flange 762 may be understood to define a first plane while the substrate seating surface 768 defines a second plane parallel to the first plane wherein the Shoulder 764 is disposed between the two planes. However, electric contact element design shown in FIG. 5 is intended to be merely illustrative. In another embodiment, the shoulder portion 764 may be of a steeper angle including a substantially vertical angle so as to be substantially normal to both the flange 762 and the substrate seating surface 768. Alternatively, the electric contact element 466 may be substantially planar thereby eliminating the shoulder portion 764. However, for reasons described below, a preferred embodiment comprises the shoulder portion 764 shown in FIG. 4 or some variation thereof.

The conducting members 765 are defined by a plurality of outer electrical contact pads 780 annularly disposed on the flange 762, a plurality of inner electrical contact pads 772 disposed on a portion of the substrate seating surface 768, and a plurality of embedded conducting connectors 776 which link the pads 772, 780 to one another. The conducting members 765 are isolated from one another by the insulative body 770. The insulative body may be made of a plastic such as polyviniylidenefluoride (PVDF), perfluoroalkoxy resin (PFA), TEFLON® (a registered trademark of the E.I. duPont de Nemours and Company) and TEFZEL® (a registered trademark of the E.I. duPont de Nemours and Company) or any other insulating material such as Alumina ($Al_2O_3$) or other ceramics. The outer contact pads 780 are coupled to a power supply, not shown, to deliver current and voltage to the inner contact pads 772 via the connectors 776 during processing. In turn, the inner contact pads 772 supply the current and voltage to a substrate by maintaining contact around a peripheral portion of the substrate. Thus, in operation the conducting members 765 act as discrete current paths electrically connected to a substrate.

Low resistivity, and conversely high conductivity, are directly related to good plating. To ensure low resistivity, the conducting members 765 are preferably made of copper (Cu), platinum (Pt), tantalum (Ta), titanium (Ti), tungsten (W), gold (Au), silver (Ag), stainless steel or other conducting materials. Low resistivity and low contact resistance may also be achieved by coating the conducting members 765 with a conducting material. Thus, the conducting members 765 may, for example, be made of copper, that has a resistivity of approximately $2\times10^{-8}$ Ω·m, coated with platinum that has a resistivity of approximately $10.6\times10^{-8}$ Ω·m. Coatings such as tantalum nitride (TaN), titanium nitride (TiN), rhodium (Rh), Au, Cu, or Ag on a conductive base materials such as stainless steel, molybdenum (Mo), Cu, and Ti are also possible. Further, since the contact pads 772, 780 are typically separate units bonded to the conducting connectors 776, the contact pads 772, 780 may comprise one material, such as Cu, and the conducting members 765 another, such as stainless steel. Either or both of the pads 772, 180 and conducting connectors 776 may be coated with a conducting material. Additionally, because plating repeatability may be adversely affected by oxidation that acts as III insulator, the inner contact pads 772 preferably comprise a material resistant to oxidation such as Pt, Ag, or Au.

In addition to being a function of the contact material, the total resistance of each circuit is dependent on the geometry, or shape, of the inner contact inner contact pads 772 and the force supplied by the contact ring 466. These factors define a constriction resistance, $R_{CR}$, at the interface of the inner contact pads 772 and the substrate seating surface 768 due to asperities between the two surfaces. Generally, as the applied force is increased the apparent area is also increased. The apparent area is, in turn, inversely related to $R_{CR}$ so that an increase in the apparent area results in a decreased $R_{CR}$. Thus, to minimize overall resistance it is preferable to maximize force. The maximum force applied in operation is limited by the yield strength of a substrate which may be damaged under excessive force and resulting pressure. However, because pressure is related to both force and area, the maximum sustainable force is also dependent on the geometry of the inner contact pads 772. Thus, while the contact pads 772 may have a flat upper surface as in FIG. 5, other shapes may be used to advantage such as a knife-edge contact pad or a hemispherical contact pad, both of which are generally known. A person skilled in the art will readily recognize other shapes which may be used to advantage. A more complete discussion of the relation between contact geometry, force, and resistance is given in Ney Contact Manual, by Kenneth E. Pitney, The J. M. NEY COMPANY, 1973, which is hereby incorporated by reference in its entirety.

The number of connectors 776 may be varied depending on the particular number of desired contact pads 772, shown in FIG. 5. For a 200 mm substrate, preferably at least twenty-four connectors 776 are spaced equally over 360°. However, as the number of connectors reaches a critical level, the compliance of the substrate relative to the contact ring 466 is adversely affected. Therefore, while more than twenty-four connectors 776 may be used, contact uniformity may eventually diminish depending on the topography of the contact pads 772 and the substrate stiffness. Similarly, while less than twenty-four connectors 776 may be used, current flow is increasingly restricted and localized, leading to poor plating results. It is desired to select a number of connectors that provides for simple computations as to me angle between adjacent connectors to provide uniform spacing. For example, if twelve connectors are used, then the uniform spacing would provide one connector each 30 degrees. When twenty-four connectors are used, the uniform spacing between adjacent connectors becomes 15 degrees. Any multiple of twelve provides simple computation of angles between adjacent connectors. Since the dimensions of the process cell can be configured to suit a particular application. For example, the dimensions would be changed to compensate between a 200 and a 300 mm substrate.

Figure 6:
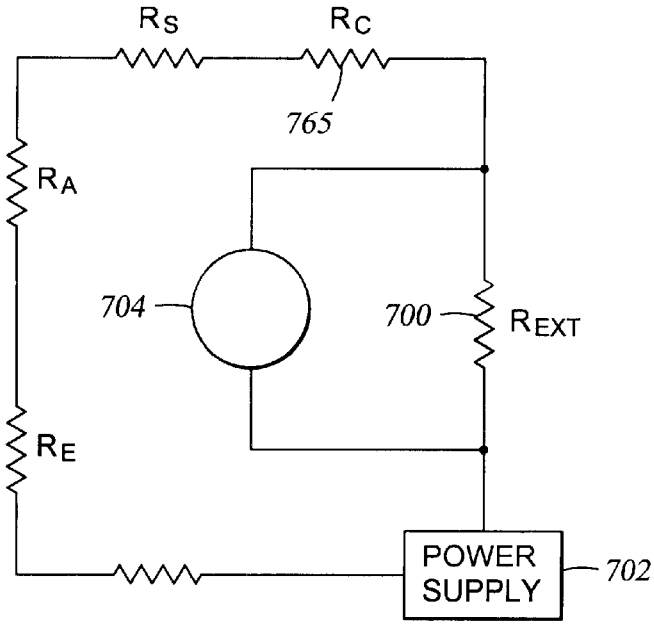
FIG. 6 is a simplified schematic diagram of the electrical circuit representing the electroplating system through each contact.

FIG. 6 is a simplified schematic diagram representing a possible configuration of the electrical circuit for the contact ring 466. To provide a uniform current distribution between the conducting members 765, an external resistor 700 is connected in series with each of the conducting members 765. Preferably, the resistance value of the external resistor 700, represented as $R_{EXT}$, is much greater than the resistance of any other component of the circuit. As shown in FIG. 6, the electrical circuit through each conducting member 765 is represented by the resistance of each of the components connected in series with the power supply 702. $R_E$ represents the resistance of the electrolyte solution which is typically dependent on the distance between the anode and the cathode contact ring and the chemical composition of the electrolyte solution. Thus, $R_A$ represents the resistance of the electrolyte solution adjacent the substrate plating surface 754. $R_S$ represents the resistance of the substrate plating surface 754, and $R_C$ represents the resistance of the cathode conducting members 765 plus the constriction resistance resulting at the interface between the inner contact pads 772 and the substrate plating layer 754. Generally, the resistance value of the external resistor ($R_{EXT}$) is at least as much as $\Sigma R$, where $\Sigma R$ equals the sum of $R_E$, $R_A$, $R_S$ and $R_C$. Preferably, the resistance value of the external resistor ($R_{EXT}$) is much greater than $\Sigma R$ such that $\Sigma R$ is negligible and the resistance of each series circuit approximates $R_{EXT}$.

Typically, one power supply is connected to all of the outer contact pads 780 of the electric contact element 466, resulting in parallel circuits through the inner contact pads 772. However, as the inner contact pad-to-substrate interface resistance varies with each inner contact pad 772, more current will flow, and thus more plating will occur, at the site of lowest resistance. However, by placing an external resistor in series with each conducting member 765, the value or quantity of electrical current passed through each conducting member 765 becomes controlled mainly by the value of the external resistor. The electric current through those conducting members that exceed other electric conductors can be relatively reduced by the addition of the external resistors in series with the conducting members. As a result, the variations in the electrical properties between each of the inner contact pads 772 can be modified to not affect the current distribution on the substrate. The uniform current density applied across the plating surface contributes to a uniform plating thickness of the metal film deposited on the seed layer on the substrate. The external resistors also provide a uniform current distribution between different substrates of a process-sequence.

Although the contact ring 466 is designed to resist deposit buildup on the inner contact pads 772, over multiple substrate plating cycles the substrate-pad interface resistance may increase, eventually reaching an unacceptable value. An electronic sensor/alarm 704 can be connected across the external resistor 700 to monitor the voltage/current across the external resistor to address this problem. If the voltage/current across the external resistor 700 falls outside of a preset operating range that is indicative of a high substrate-pad resistance, the sensor/alarm 704 triggers corrective measures such as shutting down the plating process until the problems are corrected by an operator. Alternatively, a separate power supply can be connected to each conducting member 765 and can be separately controlled and monitored to provide a uniform current distribution across the substrate. A very smart system (VSS) may also be used to modulate the current flow. The VSS typically comprises a processing unit and any combination of devices known in the industry used to supply and/or control current such as variable resistors, separate power supplies, etc. As the physiochemical, and hence electrical, properties of the inner contact pads 772 change over time, the VSS processes and analyzes data feedback. The data is compared to pre-established setpoints and the VSS then makes appropriate current and voltage alterations to ensure uniform deposition.

Figure 9:
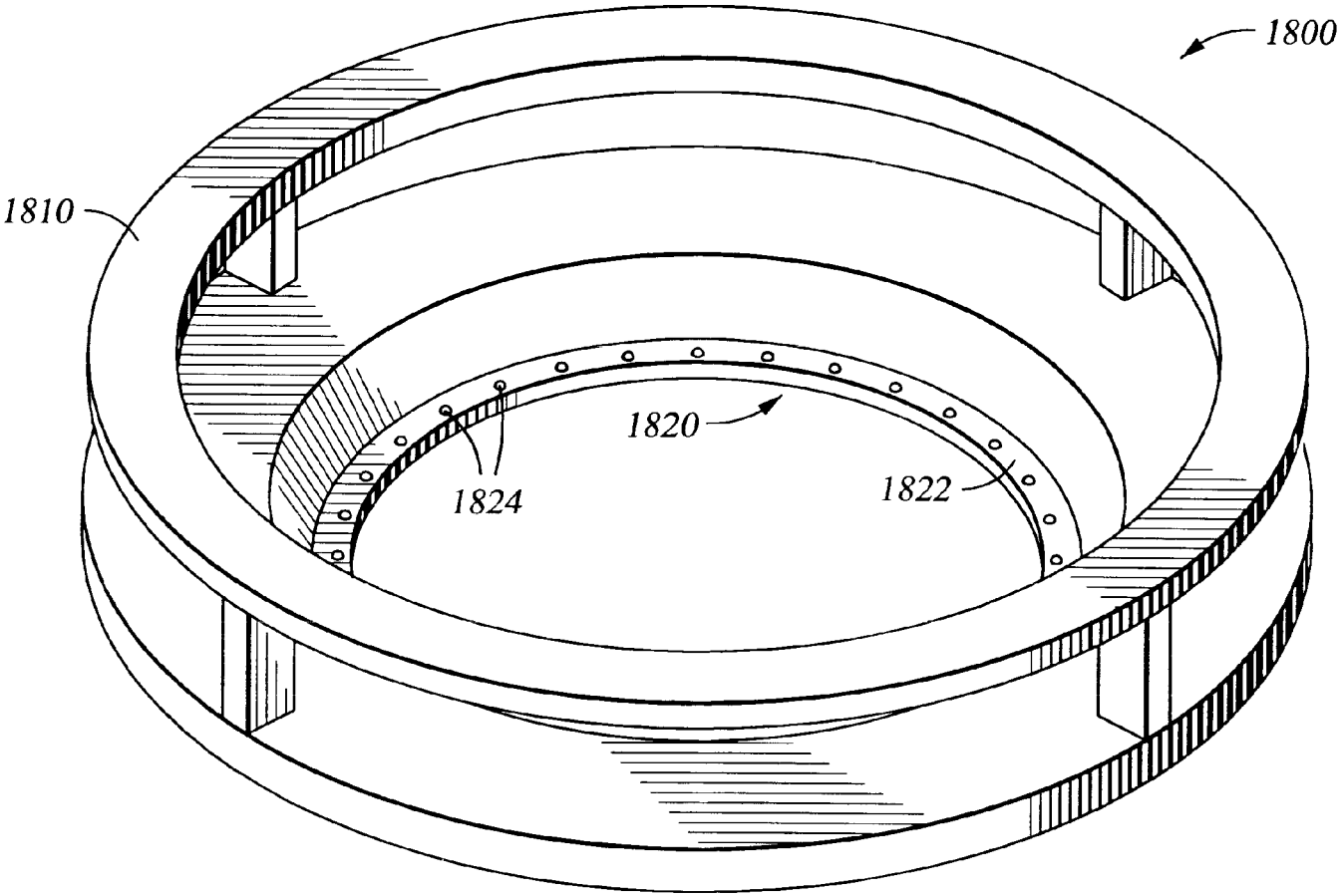
FIG. 9 is a perspective view of an alternative embodiment of a cathode contact

FIG. 9 is a perspective view of an alternative embodiment of a cathode contact ring 1800. The cathode contact ring 1800 comprises a conductive metal or a metal alloy, such as stainless steel, copper, silver, gold, platinum, titanium, tantalum, and other conductive materials, or a combination of conductive materials, Such as stainless steel coated with platinum. The cathode contact ring 1800 includes an upper mounting portion 1810 adapted for mounting the cathode contact ring onto the substrate holder assembly and a lower substrate receiving portion 1820 adapted for receiving a substrate therein. The substrate receiving portion 1820 includes an annular substrate seating surface 1822 having a plurality of contact pads or bumps 1824 disposed thereon and preferably evenly spaced apart. When a substrate is positioned on the substrate seating surface 1822, the contact pads 1824 physically contact a peripheral region of the substrate to provide electrical contact to the electroplating seed layer on the substrate deposition surface. Preferably, the contact pads 1824 are coated with a noble metal, such as platinum or gold, that is resistant to oxidation.

The exposed surfaces of the cathode contact ring, except the surfaces of the contact pads that come in contact with the substrate, are preferably treated to provide hydrophilic surfaces or coated with a material that exhibits hydrophilic properties. Hydrophilic materials and hydrophilic surface treatments are known in the art. One company providing a hydrophilic surface treatment is Millipore Corporation, located in Bedford, Mass. The hydrophilic surface significantly reduces beading of the electrolyte solution on the surfaces of the cathode contact ring and promotes smooth dripping of the electrolyte solution from the cathode contact ring after the cathode contact ring is removed from the electroplating bath or electrolyte solution. By providing hydrophilic Surfaces on the cathode contact ring that facilitate run-off of the electrolyte solution, plating defects caused by residual electrolyte solution on the cathode contact ring are significantly reduced. The inventors also contemplate application of this hydrophilic treatment or coating in other embodiments of cathode contact rings to reduce residual electrolyte solution beading on the cathode contact ring and the plating defects on a subsequently processed substrate that may result therefrom.

Figure 15:
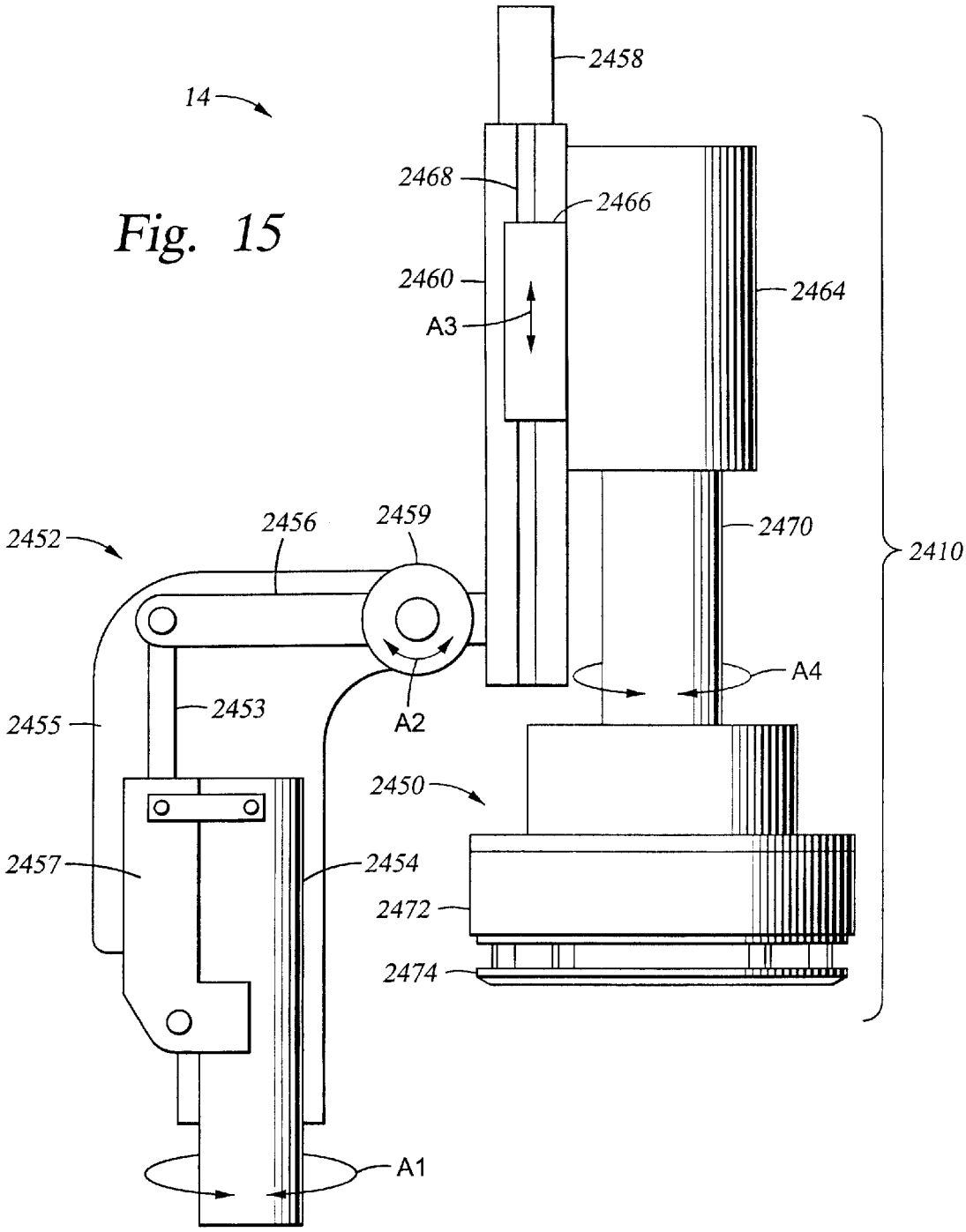
FIG. 15 is an alternative embodiment of a substrate holder system having a rotatable head assembly.

FIG. 15 is an alternative embodiment of the process head assembly having a rotatable head assembly 2410 that may be utilized in place of the head assembly 410 shown in FIG. 4. Preferably, a rotational actuator is disposed on the cantilevered arm and attached to the head assembly to rotate the head assembly during substrate processing. The rotatable head assembly 2410 is mounted onto a head assembly frame 2452. The alternative head assembly frame 2452 and the rotatable head assembly 2410 are mounted onto the mainframe similarly to the head assembly frame 452 and head assembly 410 as shown in FIG. 4 and described above. The head assembly frame 2452 includes a mounting post 2454, a post cover 2455, and a cantilever arm 2456. The mounting post 2454 is mounted onto the body of the mainframe 214, and the post cover 2455 covers a top portion of the mounting post 2454. Preferably, the mounting post 454 provides rotational movement, as indicated by arrow Al, with respect to a vertical axis along the mounting post to allow rotation of the head assembly frame 2452. The cantilever arm 2456 extends laterally from an upper portion of the mounting post 2454 and is pivotally connected to the post cover 2455 at the pivot joint 2459. The rotatable head assembly 2410 is attached to a mounting slide 2460 disposed at the distal end of the cantilever arm 2456. The mounting slide 2460 guides the vertical motion of the head assembly 2410. A head lift actuator 2458 is disposed on top of the mounting slide 2460 to provide vertical displacement of the head assembly 2410.

The lower end of the cantilever arm 2456 is connected to the shaft 2453 of a cantilever arm actuator 2457, such as a pneumatic cylinder or a lead-screw actuator, mounted on the mounting post 2454. The cantilever arm actuator 2457 provides pivotal movement, as indicated by arrow A2, of the cantilever arm 2456 with respect to the joint 2459 between the cantilever arm 2456 and the post cover 2454. When the cantilever arm actuator 2457 is retracted, the cantilever arm 2456 moves the head assembly 2410 away from the electrolyte cell 420. The movement of the head assembly 2410 provides the spacing required to remove and/or replace the electrolyte cell 420 from the electrolyte cell 240. When the cantilever arm actuator 2457 is extended, the cantilever arm 2456 moves the head assembly 2410 toward the electrolyte cell 420 to position the substrate in the head assembly 2410 in a processing position.

The rotatable head assembly 2410 includes a rotating actuator 2464 slideably connected to the mounting slide 2460. The shaft 2468 of the head lift actuator 2458 is inserted through a lift guide 2466 attached to the body of the rotating actuator 2464. Preferably, the shaft 2468 is a lead-screw type shaft that moves the lift guide, as indicated by arrows A3, between various vertical positions. The rotating actuator 2464 is connected to the substrate holder assembly 2450 through the shaft 2470 and rotates the substrate holder assembly 2450, as indicated by arrows A.4. The substrate holder assembly 2450 may include a bladder assembly. To seal a portion of the backside of the substrate (that faces upwardly in the substrate holder assembly) against the electrolyte solution contained in the electrolyte cell, a cathode contact ring is provided, such as shown in the embodiments described above with respect to FIG. 4.

The rotation of the substrate during the electroplating process generally enhances the deposition results. Preferably, the head assembly is rotated between about 2 rpm and about 200 rpm, preferably between about 20 and 40 rpm, during the electroplating process. The substrate holder assembly 2472 can be rotated to impart rotation to the substrate as the substrate holder system 14 immerses by lowering the seed layer on the substrate into contact with the electrolyte solution in the process cell. The head assembly is raised to remove the seed layer on the substrate from the electrolyte solution in the process cell. The head assembly is preferably rotated at a high speed, i.e., between about 100 and about 2500 rpm, after the head assembly is lifted from the process cell to enhance removal of residual electrolyte solution from the head assembly by centrifugal force.

In one embodiment, the uniformity of the deposited film has been improved within about 2%, i.e., maximum deviation of deposited film thickness is at about 2% of the average film thickness, while standard electroplating processes typically achieves uniformity at best within about 5.5%. However, rotation of the head assembly is not necessary to achieve uniform electroplating deposition in some instances, particularly where the uniformity of electroplating deposition is achieved by adjusting the processing parameters, such as the chemicals in the electrolyte solution, electrolyte solution flow and other parameters.

FIG. 4 shows a cross sectional view of the electroplating process cell 400, including the substrate holder assembly 450 positioned above the electrolyte cell 420. The electrolyte cell 420 generally comprises a bowl 430, a container body 472, an anode assembly 474, and a filter 476. Preferably, the anode assembly 474 is disposed below the container body 472 and attached to a lower portion of the container body 472, and the filter 476 is disposed between the anode assembly 474 and the container body 472. The container body 472 is preferably a cylindrical body comprised of an electrically insulative material, such as ceramics, plastics, PLEXIGLAS® (acrylic), lexane, PVC, CPVC, and PVDF. Alternatively, the container body 472 can be made from a coated metal, such as stainless steel, nickel and titanium. The coated metal is coated with an insulating layer such as TEFLON® (a trademark of the E. I. duPont de Nemoirs Company of Wilmington, Del.), PVDF, plastic, rubber and other combinations of materials that do not dissolve in the electrolyte solution. The insulating layer can be electrically insulated from the electrodes, i.e., the anode and cathode of the ECP system. The container body 472 is preferably sized and adapted to conform to the substrate plating surface and the shape of a substrate being processed through the system, typically circular or rectangular in shape. One preferred embodiment of the container body 472 comprises a cylindrical ceramic tube having an inner diameter that has about the same dimension as or slightly larger than the substrate diameter. Rotational movement typically required in typical ECP systems is not required to achieve uniform plating results when the size of the container body conforms to about the size of the substrate plating surface.

An upper portion of the container body 472 extends radially outwardly to form an annular weir 478. The weir 478 extends over the inner wall 446 of the electrolyte solution collector 440 and allows the electrolyte solution to flow into the electrolyte solution collector 440. The upper surface of the weir 478 preferably matches the lower surface of the electric contact element 466. Preferably, the upper surface of the weir 478 includes an inner annular flat portion 480, a middle inclined portion 482 and an outer declined portion 484. When a substrate is positioned in the processing position, the substrate plating surface is positioned above the cylindrical opening of the container body 472. A gap for electrolyte solution flow is formed between the lower Surface of the electric contact element 466 and the upper surface of the weir 478. The lower surface of the electric contact element 466 is disposed above the inner flat portion 480 and the middle inclined portion of the weir 478. The outer declined portion 484 is sloped downwardly to facilitate flow of the electrolyte solution into the electrolyte solution collector 440.

A lower portion of the container body 472 extends radially outwardly to form a lower annular flange 486 for securing the container body 472 to the bowl 430. The outer dimension, i.e., circumference, of the annular flange 486 is smaller than the dimensions of the opening 444 and the inner circumference of the electrolyte solution collector 440. The smaller dimension of the annular flange to allow removal and replacement of the electrolyte cell 420 from the electroplating process cell 400. Preferably, multiple bolts 488 arc fixedly disposed on the annular flange 486 and extend downwardly through matching bolt holes on the bowl 430. A plurality of removable fastener nuts 490 secures the electrolyte cell 420 onto the bowl 430. A seal 487, such as an elastomer O-ring, is disposed between container body 472 and the bowl 430 radially inwardly from the bolts 488 to prevent leaks from the electrolyte cell 420. The nuts/bolts combination facilitates fast and easy removal and replacement of the components of the electrolyte cell 420 during maintenance.

Preferably, the filter 476 is attached to and completely covers the lower opening of the container body 472, and the anode assembly 474 is disposed below the filter 476. A spacer 492 is disposed between the filter 476 and the anode assembly 474. Preferably, the filter 476, the spacer 492, and the anode assembly 474 are fastened to a lower surface of the container body 472 using removable fasteners, such as screws and/or bolts. Alternatively, the filter 476, the spacer 492, and the anode assembly 474 are removably secured to the bowl 430.

The anode assembly 474 preferably comprises a consumable anode that serves as a metal ion source in the electrolyte solution. Alternatively, the anode assembly 474 comprises a non-consumable anode, and the metal ions to be electroplated are supplied within the electrolyte solution from the electrolyte solution replenishing system 220. As shown in FIG. 4, the anode assembly 474 is a self-enclosed module having a porous anode enclosure 494 preferably made of the same metal as the metal ions to be electroplated, such as copper. Alternatively, the anode enclosure 494 is made of porous materials, such as ceramics or polymeric membranes. A soluble metal 496, such as high purity copper for electrochemical plating of copper, is disposed within the anode enclosure 494. The soluble metal 496 preferably comprises metal particles, wires or a perforated sheet. The porous anode enclosure 494 also acts ;s a filter that keeps the particulates generated by the dissolving metal within the anode enclosure 494. As compared to a non-consumable anode, the consumable, i.e., soluble, anode provides gas-generation-free electrolyte solution and minimizes the need to constantly replenish the metal ions contained in the electrolyte solution.

An anode electrode contact 498 is inserted through the anode enclosure 494 to provide electrical connection to the soluble metal 496 from a power supply. Preferably, the anode electrode contact 498 is made from a conductive material that is insoluble in the electrolyte solution, such as titanium, platinum and platinum-coated stainless steel. The anode electrode contact 498 extends through the bowl 430 and is connected to an electrical power supply. Preferably, the anode electrical contact 498 includes a threaded portion 497 for a fastener nut 499 to secure the anode electrical contact 498 to the bowl 430, and a seal 495 such as a elastomer washer. The washer is disposed between the fastener nut 499 and the bowl 430 to prevent leaks from the electrolyte cell 420.

The bowl 430 generally comprises a cylindrical portion 502 and a bottom portion 504. An upper annular flange 506 extends radially outwardly from the top of the cylindrical portion 502. The upper annular flange 506 includes a plurality of holes 508 that matches the number of bolts 488 from the lower annular flange 486 of the container body 472. Bolts 488 are inserted through the holes 508, and the fastener nuts 490 are fastened onto the bolts 488 that secure the upper annular flange 506 of the bowl 430 to the lower annular flange 486 of the container body 472. Preferably, the outer dimension, i.e., circumference, of the upper annular flange 505 is about the same as the outer dimension, i.e., circumference, of the lower annular flange 486. Preferably, the lower surface of the upper annular flange 506 of the bowl 430 rests on a support flange of the mainframe 214 when the electrolyte cell 420 is positioned on the mainframe 214.

The inner circumference of the cylindrical portion 502 accommodates the anode assembly 474 and the filter 476. Preferably, the outer dimensions of the filter 476 and the anode assembly 474 are slightly smaller than the inner dimension of the cylindrical portion 502. These relative dimensions force a substantial portion of the electrolyte solution to flow through the anode assembly 474 first before flowing through the filter 476. The bottom portion 504 of the bowl 430 includes an electrolyte solution inlet 510 that connects to an electrolyte solution supply line from the electrolyte solution replenishing system 220. Preferably, the anode assembly 474 is disposed about a middle portion of the cylindrical portion 502 of the bowl 430. The anode assembly 474 is configured to provide a gap for electrolyte solution flow between the anode assembly 474 and the electrolyte solution inlet 510 on the bottom portion 504.

The electrolyte solution inlet 510 and the electrolyte solution supply line are preferably connected by a releasable connector that facilitates easy removal and replacement of the electrolyte cell 420. When the electrolyte cell 420 needs maintenance, the electrolyte solution is drained from the electrolyte cell 420, and the electrolyte solution flow in the electrolyte solution supply line is discontinued and drained. The connector for the electrolyte solution supply line is released from the electrolyte solution inlet 510, and the electrical connection to the anode assembly 474 is also disconnected. The head assembly 410 is raised or rotated to provide clearance for removal of the electrolyte cell 420. The electrolyte cell 420 is then removed from the mainframe 214, and a hew or reconditioned process cell is replaced into the mainframe 214.

Alternatively, the bowl 430 can be secured onto the support flange of the mainframe 214, and the container body 472 along with the anode and the filter are removed for maintenance. In this case, the nuts securing the anode assembly 474 and the container body 472 to the bowl 430 are removed to facilitate removal of the anode assembly 474 and the container body 472. New or reconditioned anode assembly 474 and container body 472 are then replaced into the mainframe 214 and secured to the bowl 430.

Figure 10:
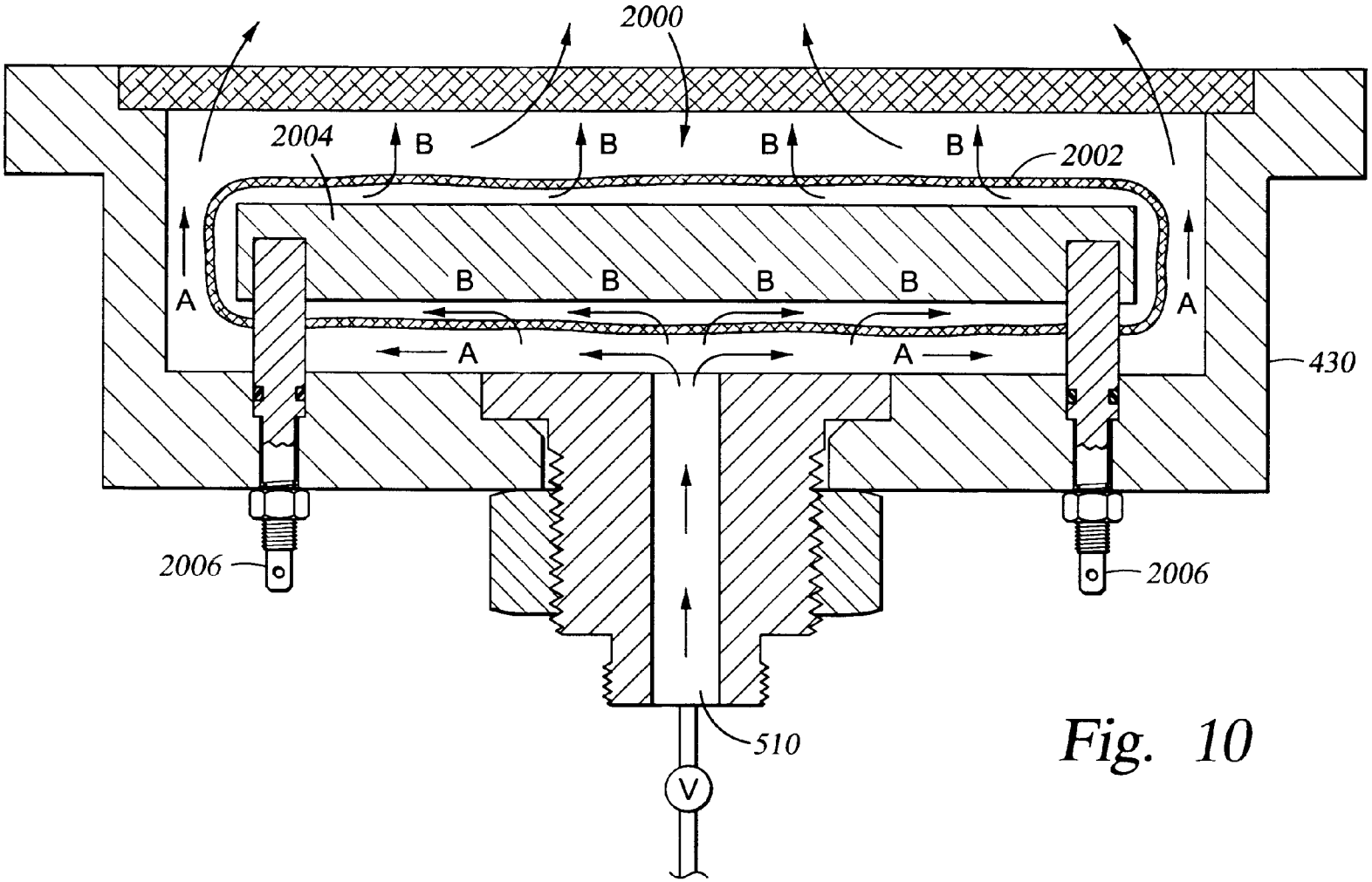
FIG. 10 is a cross sectional view of a one embodiment of an encapsulated anode.

FIG. 10 is a cross sectional view of one embodiment of an encapsulated anode. The encapsulated anode 2000 includes a permeable anode enclosure that filters or traps "anode sludge" or particulates generated by the anode as a waste product. As shown in FIG. 10, the anode plate 2004 comprises a solid piece of copper. Preferably, the anode plate 2004 is a high purity, oxygen free copper, enclosed in a hydrophilic anode encapsulation membrane 2002. The anode plate 2004 is secured and supported by a plurality of electrical contacts or feed-throughs 2006 that extend through the bottom of the bowl 430. The electrical contacts or feed-throughs 2006 extend through the anode encapsulation membrane 2002 into the bottom surface of the anode plate 2004. The flow of the electrolyte solution, as indicated by the arrow A, from the electrolyte solution inlet 510 disposed at the bottom of the bowl 430 through the gap between the anode and the bowl sidewall. The electrolyte solution also flows through the anode encapsulation membrane 2002 by permeation into and out of the gap between the anode encapsulation membrane and the anode plate, as indicated by the arrow B. Preferably, the anode encapsulation membrane 2002 comprises a hydrophilic porous membrane, such as a modified polyvinyllidene fluoride membrane, having porosity between about 60% and 80%, more preferably about 70%, and pore sizes between about 0.025 $\mu$m and about 1 μm, more preferably between about 0.1 μm and about 0.2 μm. One example of a hydrophilic porous membrane is the Durapore Hydrophilic Membrane, available from Millipore Corporation, located in Bedford, Mass. As the electrolyte solution flows through the encapsulation membrane, anode sludge and particulates generated by the dissolving anode are filtered or trapped by the encapsulation membrane. Thus, the encapsulation membranes improve the purity of the electrolyte solution during the electroplating process, and defect formations on the substrate during the electroplating process caused by anode sludge and contaminant particulates are significantly reduced.

Figure 11:
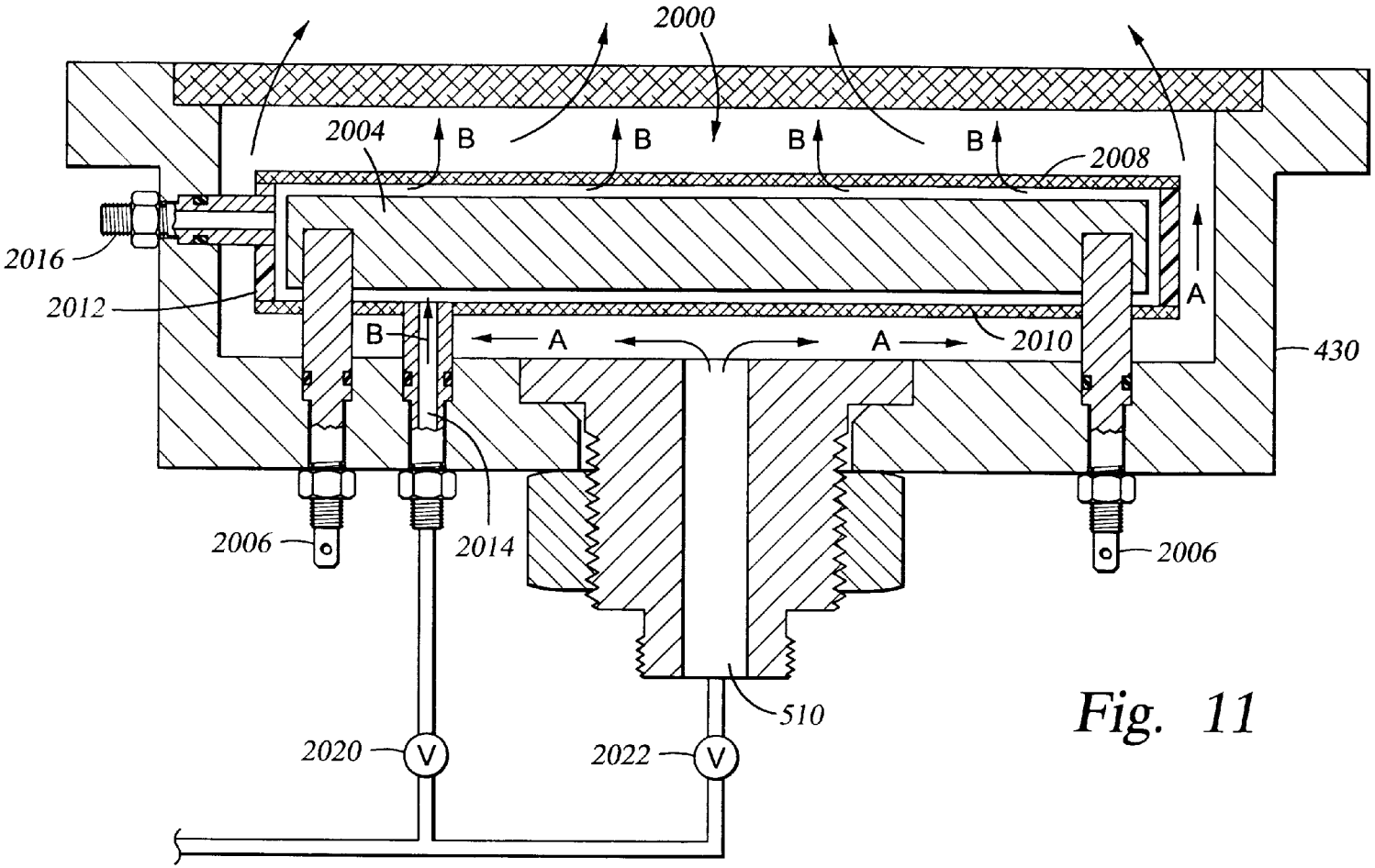
FIG. 11 is a cross sectional view of another embodiment of an encapsulated anode.

FIG. 11 is a cross sectional view of another embodiment of an encapsulated anode. The anode plate 2004 is secured and supported on the electrical feed-throughs 2006. A top encapsulation membrane 2008 and a bottom encapsulation membrane 2010, disposed respectively above and below the anode plate 2004, are attached to a membrane support ring 2012 that is disposed around the anode plate 2004. The top and bottom encapsulation membranes 2008, 2010 comprise a material from the list above. The membrane support ring 2012 preferably comprises a relatively rigid material as compared to the encapsulation membrane, such as plastic or other polymers. A bypass fluid inlet 2014 is disposed through the bottom of the bowl 430 and through the bottom encapsulation membrane 2010 to introduce electrolyte solution into the gap between the encapsulation membranes and the anode plate. A bypass outlet 2016 is connected to the membrane support ring 2012 and extends through the bowl 430 to facilitate flow of excess electrolyte solution with the anode sludge or generated particulates out of the encapsulated anode into a waste drain, not shown.

Preferably, the electrolyte solution flows within the bypass fluid inlet 2014 and the main electrolyte solution inlet 510 are individually controlled by flow control valves 2020, 2022. The individual flow control valves 2020, 2022 are respectively placed along the fluid lines connected to the inlets. The fluid pressure in the bypass fluid inlet 2014 is preferably maintained at a higher pressure than the pressure in the main electrolyte solution inlet 510. She flow of the electrolyte solution inside the bowl 430 from the main electrolyte solution inlet 510 is indicated by arrows A, and the flow of the electrolyte solution inside the encapsulated anode 2000 is indicated by the arrows B. A portion of the electrolyte solution introduced into the encapsulated anode flows out of the encapsulated anode through the bypass outlet 2016. By providing a dedicated bypass electrolyte solution supply into the encapsulated anode, the anode sludge or particulates generated from the dissolving anode is continually removed from the anode, thereby improving the purity of the electrolyte solution during the electroplating process.

Figure 12:
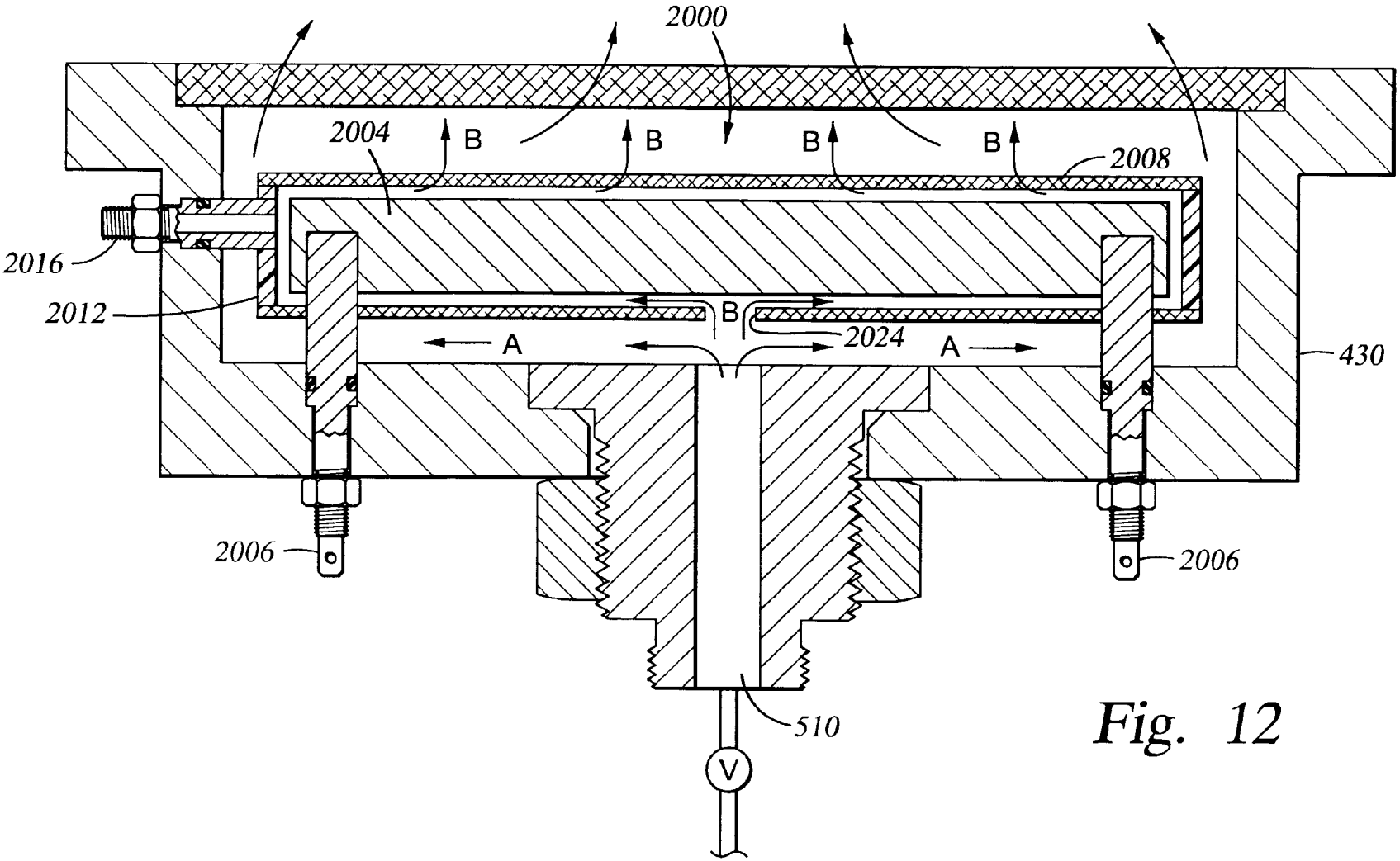
FIG. 12 is a cross sectional view of another embodiment of an encapsulated anode.

FIG. 12 is a cross sectional view of yet another embodiment of an encapsulated anode. This embodiment of an encapsulated anode 2000 includes an anode plate 2004, a plurality of electrical feed-throughs 2006, a top encapsulation membrane 2008, a bottom encapsulation membrane 2010, a membrane support ring 2012, and a bypass outlet 2016. The anode plate 2004 is secured and supported on the plurality of electrical feed-throughs 2006. The top and a bottom encapsulation membrane 2008, 2010 are attached to a membrane support ring 2012. The bypass outlet 2016 is connected to the membrane support ring 2012 and extends through the bowl 430. This embodiment of an encapsulated anode preferably comprises materials as described above for the previous-described embodiments of an encapsulated anode. The bottom encapsulation membrane 2010 includes one or more openings 2024 disposed substantially above the main electrolyte solution inlet 510. Each opening 2024 is adapted to receive flow of electrolyte solution from the main electrolyte solution inlet 510 and is preferably about the same size as the internal circumference of the main electrolyte solution inlet 510. The flow of the electrolyte solution from the main electrolyte solution inlet 510, indicated by the arrow A, and the flow of the electrolyte solution within the encapsulated anode, indicated by the arrow B. A portion of the electrolyte solution flows out of the encapsulated anode through the bypass outlet 2016, carrying a portion of the anode sludge and particulates generated from anode dissolution.

Figure 13:
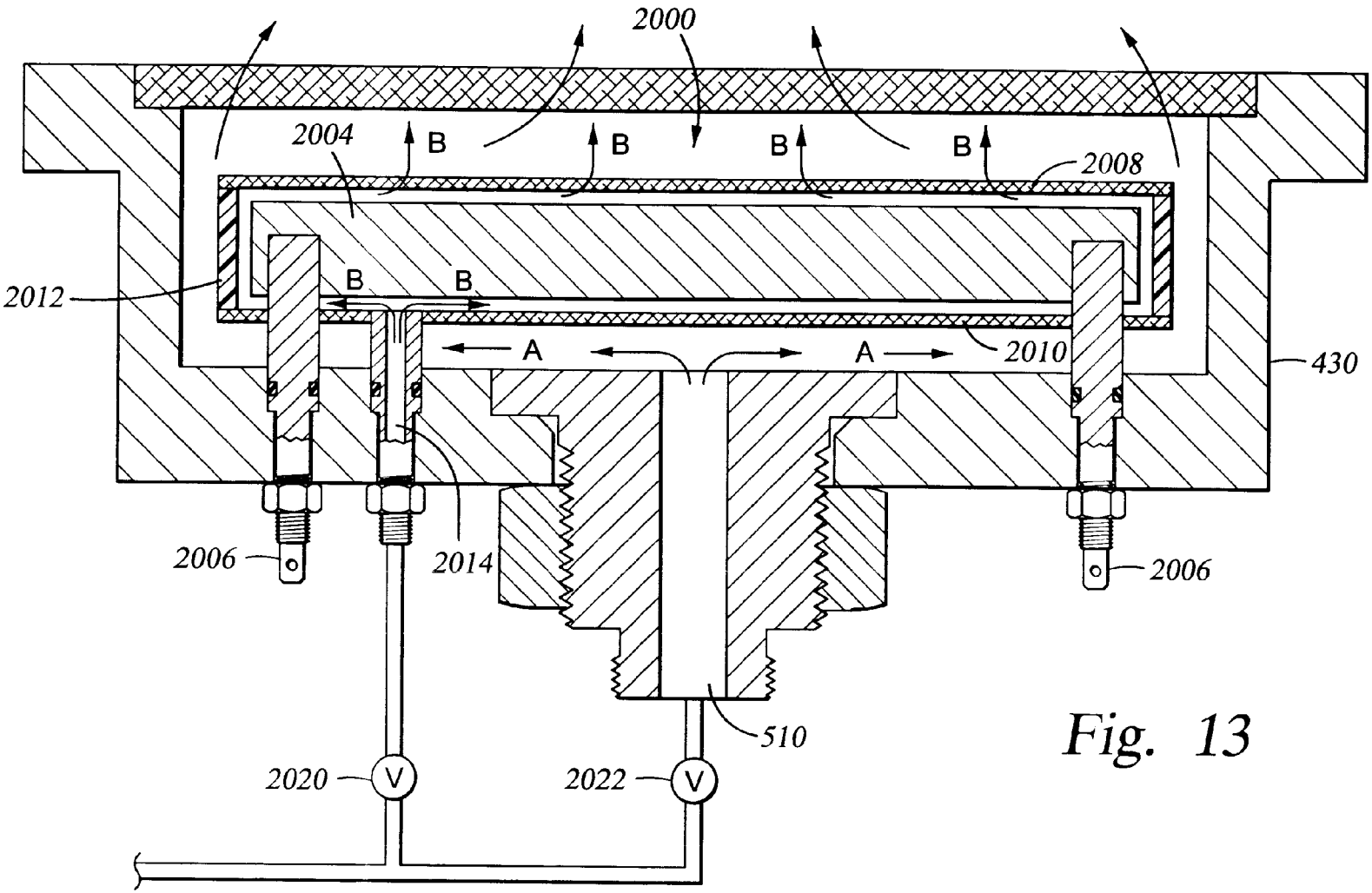
FIG. 13 is a cross sectional view of yet another embodiment of an encapsulated anode.

FIG. 13 is a cross sectional view of another embodiment of an encapsulated anode. This embodiment of an encapsulated anode 2000 includes an anode plate 2002, a plurality of electrical feed-throughs 2006, a top encapsulation membrane 2008, a bottom encapsulation membrane 2010, a membrane support ring 2012, and a bypass fluid inlet 2014. The anode plate 2002 is secured and supported on a plurality of electrical feed-throughs 2006. The top and bottom encapsulation membranes 2008, 2010 are attached to a membrane support ring 2012. A bypass fluid inlet 2014 is disposed through the bottom of the bowl 430 and through the bottom encapsulation membrane 2010 to introduce electrolyte solution into the gap between the encapsulation membranes and the anode plate. This embodiment of an encapsulated anode preferably comprises materials as described above for the above-described embodiments of an encapsulated anode. Preferably, the electrolyte solution flows through the bypass fluid inlet 2014 and the main electrolyte solution inlet 510 are individually controlled by control valves 2020, 2022, respectively. The flow of the electrolyte solution from the main electrolyte solution inlet 510 is indicated by the arrows A. The flow of the electrolyte solution through the encapsulated anode is indicated by arrow B. For this embodiment, the anode sludge and particulates generated by the dissolving anode plate are filtered and trapped by the encapsulation membranes as the electrolyte solution passes through the membrane.

Figure 7:
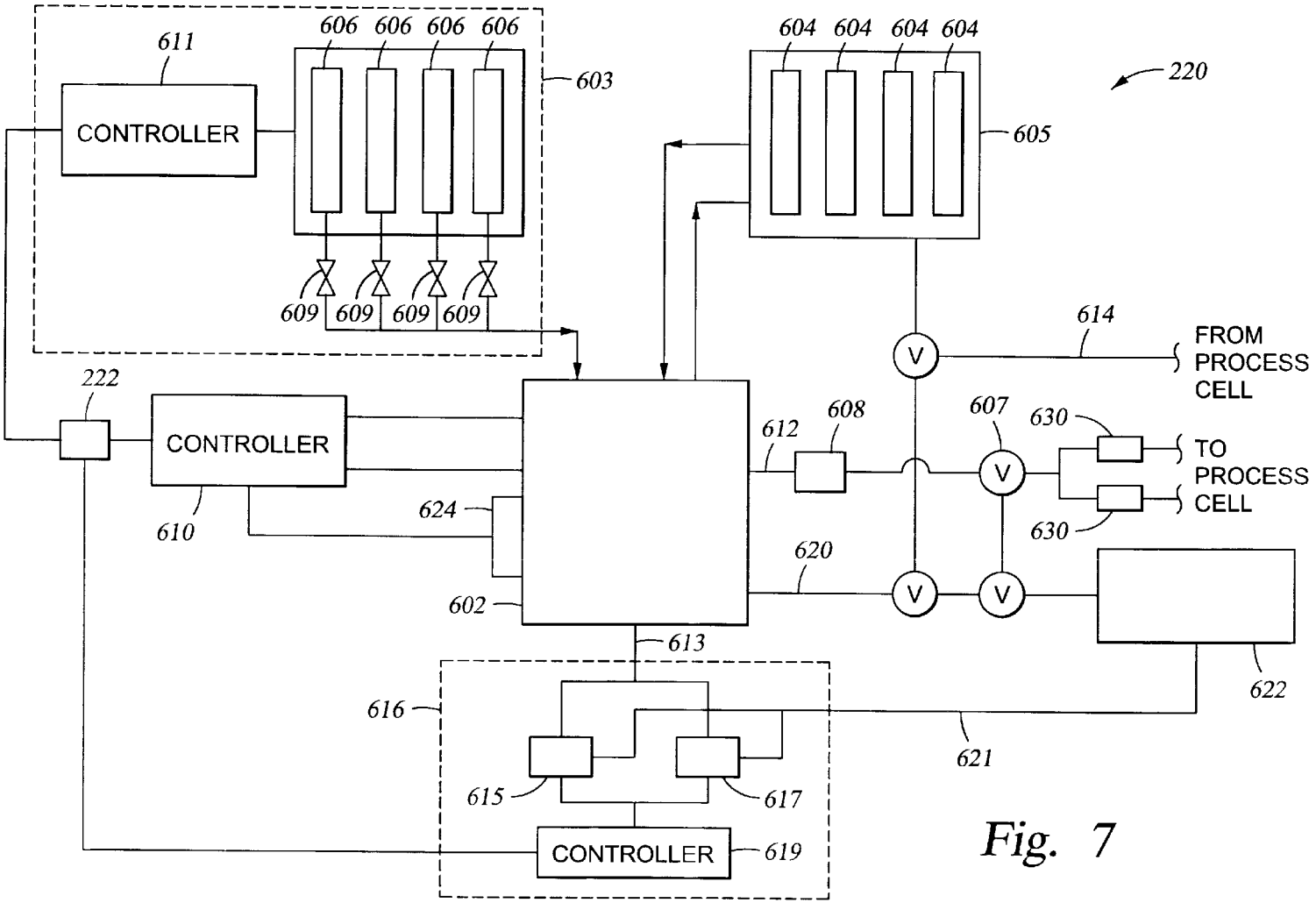
FIG. 7 is a schematic diagram of one embodiment of an electrolyte replenishing system.

FIG. 7 is a schematic diagram of one embodiment of electrolyte solution replenishing system 220. The electrolyte solution replenishing system 220 provides the electrolyte solution to the electroplating process cells for the electroplating process. The electrolyte solution replenishing system 220 generally comprises a main electrolyte solution tank 602, a dosing module 603, a filtration module 605, a chemical analyzer module 616, and an electrolyte solution waste disposal system 622. The electrolyte solution waste disposal system 622 is connected to the analyzing module 616 by an electrolyte solution waste drain 620. One or more controllers control the composition of the electrolyte solution in the main tank 602 and the operation of the electrolyte solution replenishing system 220. Preferably, the controllers are independently operable but integrated with the controller 222 of the ECP system 200.

The main electrolyte solution tank 602 provides a reservoir for electrolyte solution and includes an electrolyte solution supply line 612 that is connected to each of the electroplating process cells through one or more fluid pumps 608 and valves 607. A heat exchanger 624 or a heater/chiller disposed in thermal connection with the main tank 602 controls the temperature of the electrolyte solution stored in the main tank 602. The heat exchanger 624 is connected to and operated by the controller 610.

The dosing module 603 is connected to the main tank 602 by a supply line and includes a plurality of source tanks 606, or feed bottles, a plurality of valves 609, and a controller 611. The source tanks 606 contain the chemicals needed for composing the electrolyte solution and typically include a deionized water source tank and copper sulfate ($CuSO_4$) source tank for composing the electrolyte solution. Other source tanks 606 may contain hydrogen sulfate ($H_2SO_4$), hydrogen chloride (HCl) and various additives such as glycol. Each source tank is preferably color coded and fitted with a unique mating outlet connector adapted to connect to a matching inlet connector in the dosing module. By color coding the source tanks and fitting the source tanks with unique connectors, errors caused by human operators when exchanging or replacing the source tanks are significantly reduced.

The deionized water source tank preferably also provides deionized water to the system for cleaning the system during maintenance. The valves 609 associated with each source tank 606 regulate the flow of chemicals to the main tank 602 and may be any of numerous commercially available valves such as butterfly valves, throttle valves and the like. Activation of the valves 609 is accomplished by the controller 611 which is preferably connected to the controller 222 to receive signals therefrom.

The electrolyte solution filtration module 605 includes a plurality of filter tanks 604. An electrolyte solution return line 614 is connected between each of the process cells and one or more filter tanks 604. The filter tanks 604 remove the undesired contents in the used electrolyte solution before returning the electrolyte solution to the main tank 602 for re-use. The main tank 602 is also connected to the filter tanks 604 to facilitate re-circulation and filtration of the electrolyte solution in the main tank 602. By re-circulating the electrolyte solution from the main tank 602 through the filter tanks 604, the undesired contents in the electrolyte solution are continuously removed by the filter tanks 604 to maintain a consistent level of purity. Additionally, re-circulating the electrolyte solution between the main tank 602 and the filtration module 605 allows the various chemicals in the electrolyte solution to be thoroughly mixed.

The electrolyte solution replenishing system 220 also includes a chemical analyzer module 616 that provides real-time chemical analysis of the chemical composition of the electrolyte solution. The analyzer module 616 is fluidly coupled to the main tank 602 by a sample line 613 and to the waste disposal system 622 by an outlet line 621. The analyzer module 616 generally comprises at least one analyzer and a controller to operate the analyzer. The number of analyzers required for a particular processing tool depends on the composition of the electrolyte solution. For example, while a first analyzer may be used to monitor the concentrations of organic substances, a second analyzer is needed for inorganic chemicals. In the specific embodiment shown in FIG. 7 the chemical analyzer module 616 comprises an auto titration analyzer 615 and a cyclic voltametric stripper (CVS) 617. Both analyzers are commercially available from various suppliers. An auto titration analyzer which may be used to advantage is available from Parker Systems and a cyclic voltametric stripper is available from ECI. The auto titration analyzer 615 determines the concentrations of inorganic substances such as copper chloride and acid. The CVS 617 determines the concentrations of organic substances such as the various additives which may be used in the electrolyte solution and by-products resulting from the processing which are returned to the main tank 602 from the process cells.

The analyzer module shown FIG. 7 is merely illustrative. In another embodiment each analyzer may be coupled to the main electrolyte solution tank by a separate supply line and be operated by separate controllers. Persons skilled in the art will recognize other embodiments.

In operation, a sample of electrolyte solution is flowed to the analyzer module 616 via the sample line 613. Although the sample may be taken periodically, preferably a continuous flow of electrolyte solution is maintained to the analyzer module 616. A portion of the sample is delivered to the auto titration analyzer 615 and a portion is delivered to the CVS 617 or the appropriate analysis. The controller 619 initiates command signals to operate the analyzers 615, 617 in order to generate data. The information from the chemical analyzers 615, 617 is then communicated to the controller 222. The controller 222 processes the information and transmits signals that include user-defined chemical dosage parameters to the dosing controller 611. The received information is used to provide real-time adjustments to the source chemical replenishment rates by operating one or more of the valves 609. The received information thereby maintains a desired, and preferably constant, chemical composition of the electrolyte solution throughout the electroplating process. The waste electrolyte solution from the analyzer module is then flowed to the waste disposal system 622 via the outlet line 621.

Although a preferred embodiment utilizes real-time monitoring and adjustments of the electrolyte solution, various alternatives may be employed. For example, the dosing module 603 may be controlled manually by an operator observing the output values provided by the chemical analyzer module 616. Preferably, the system software allows for both an automatic real-time adjustment mode as well as an operator, manual, mode. Further, although multiple controllers are shown in FIG. 7, a single controller may be used to operate various components of the system such as the chemical analyzer module 616, the dosing module 603, and the heat exchanger 624. Other embodiments will be apparent to those skilled in the art.

The electrolyte solution replenishing system 220 also includes an electrolyte solution waste drain 620 connected to an electrolyte solution waste disposal system 622 for safe disposal of used electrolyte solutions, chemicals and other fluids used in the ECP system. Preferably, the electroplating cells include a direct line connection to the electrolyte solution waste drain 620, or the electrolyte solution waste disposal system 622. The electrolyte solution waste drain 620 drains the electroplating cells without returning the electrolyte solution through the electrolyte solution replenishing system 220. The electrolyte solution replenishing system 220 preferably also includes a bleed off connection to bleed off excess electrolyte solution to the electrolyte solution waste drain 620.

Preferably, the electrolyte solution replenishing system 220 also includes one or more degasser modules 630 adapted to remove undesirable gases from the electrolyte solution. The degasser module generally comprises a membrane that separates gases from the fluid passing through the degasser module and a vacuum system for removing the released gases. The degasser modules 630 are preferably placed in line on the electrolyte solution supply line 612 adjacent to the process cells 240. The degasser modules 630 are preferably positioned as close as possible to the process cells 240 so most of the gases from the electrolyte solution replenishing system are removed by the degasser modules before the electrolyte solution enters the process cells. Preferably, each degasser module 630 includes two outlets to supply degassed electrolyte solution to the two process cells 240 of each processing station 218. Alternatively, a degasser module 630 is provided for each process cell. The degasser modules can be placed at many other alternative positions. For example, the degasser module can be placed at other positions in the electrolyte solution replenishing system, such as along with the filter section or in a closed-loop system with the main tank or with the process cell. As another example, one degasser module is placed in line with the electrolyte solution supply line 612 to provide degassed electrolyte solution to all of the process cells 240 of the electro-chemical plating system. Additionally, a separate degasser module is positioned in-line or in a closed-loop With the deionized water supply line and is dedicated for removing oxygen from the deionized water source. Because deionized water is used to rinse the processed substrates, free oxygen gases are preferable removed from the deionized water before reaching the SRD modules so that the electroplated copper is less likely to become oxidized by the rinsing process. Degasser modules are well known in the art and commercial embodiments are generally available and adaptable for use in a variety of applications. A commercially available degasser module is available from Millipore Corporation, located in Bedford, Mass.

Figure 16:
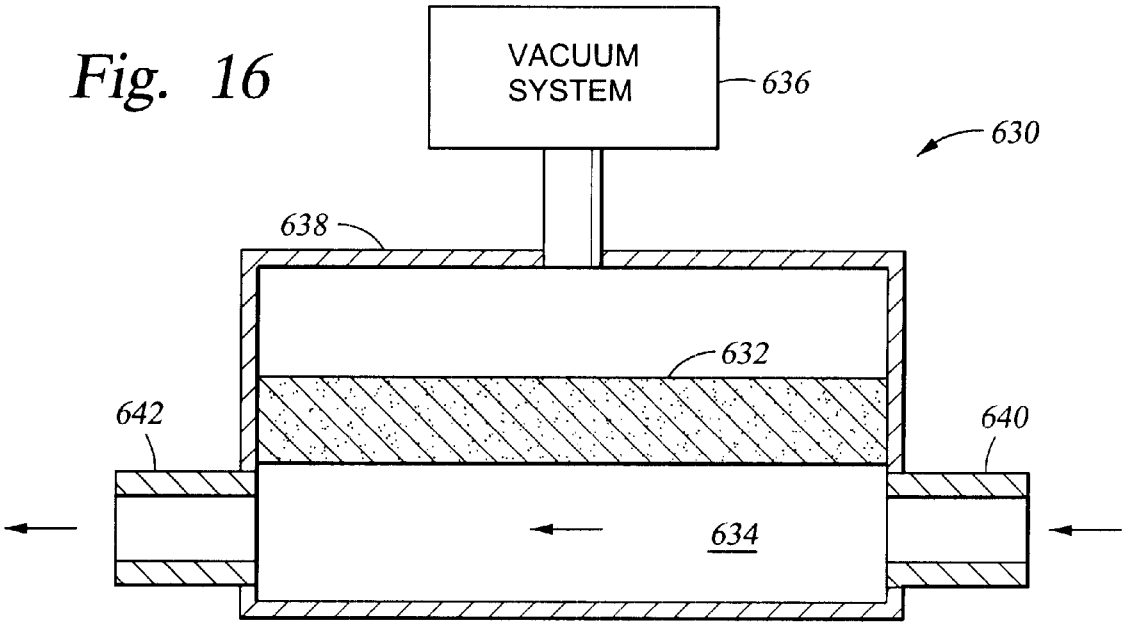
FIG. 16 is a cross sectional view of one embodiment of a degasser module.
Figure 17:
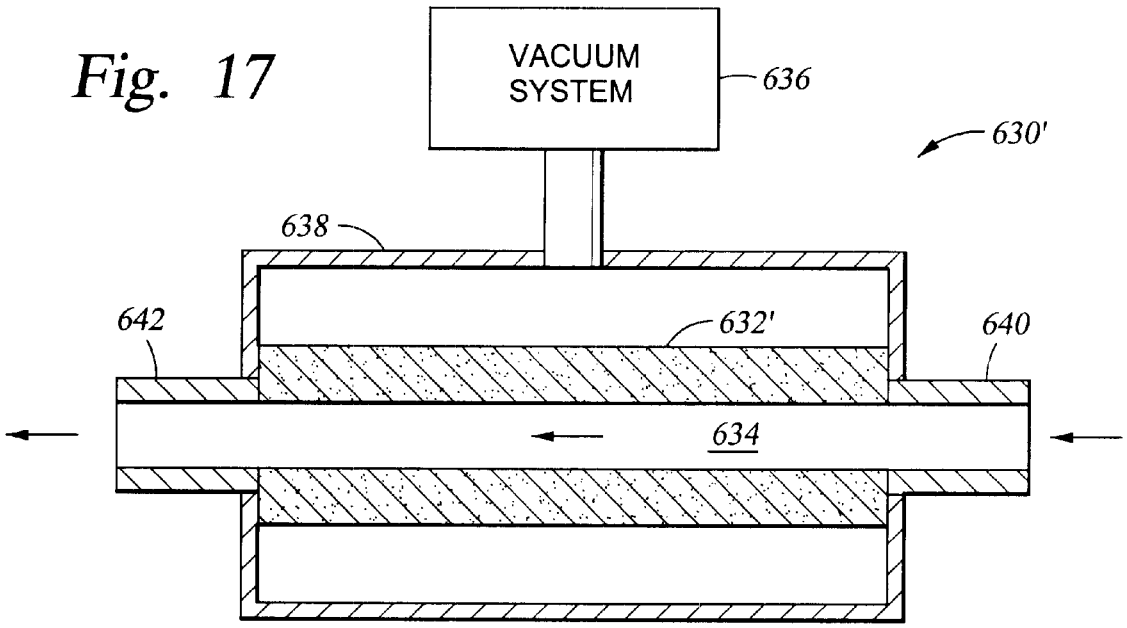
FIG. 17 is a side cross sectional view of another embodiment of degasser module.

One embodiment of the degasser module 630, as shown in FIG. 16, includes a hydrophobic membrane 632 having a fluid, i.e., electrolyte solution, passage 634 on one side of the membrane 632. A vacuum system 636 disposed on the opposite side of the membrane. The enclosure 638 of the degasser module includes an inlet 640 and one or more outlets 642. As the electrolyte solution passes through the degasser module 630, the gases and other micro-bubbles in the electrolyte solution are separated from the electrolyte solution through the hydrophobic membrane and removed by the vacuum system. Another embodiment of the degasser module 630', as shown in FIG. 17, includes a tube of hydrophobic membrane 632' and a vacuum system 636 disposed around the tube of hydrophobic membrane 632'. The electrolyte solution is introduced inside the tube of hydrophobic membrane, and as the electrolyte solution passes through the fluid passage 634 in the tube. The hydrophobic membrane separates gases and other micro-bubbles in the electrolyte solution, and a tube that is connected to the vacuum system 636 removes the separated gasses. More complex designs of degasser modules are contemplated, including designs having serpentine paths of the electrolyte solution across the membrane and other multi-sectioned designs of degasser modules.

Although not shown in FIG. 7, the electrolyte solution replenishing system 220 may include a number of other components. For example, the electrolyte solution replenishing system 220 preferably also includes one or more additional tanks for storage of chemicals for a substrate cleaning system, such as the SRD station. Double-contained piping for hazardous material connections may also be employed to provide safe transport of the chemicals throughout the system. Optionally, the electrolyte solution replenishing system 220 includes connections to additional or external electrolyte solution processing system to provide additional electrolyte solution supplies to the ECP system.

Figure 8:
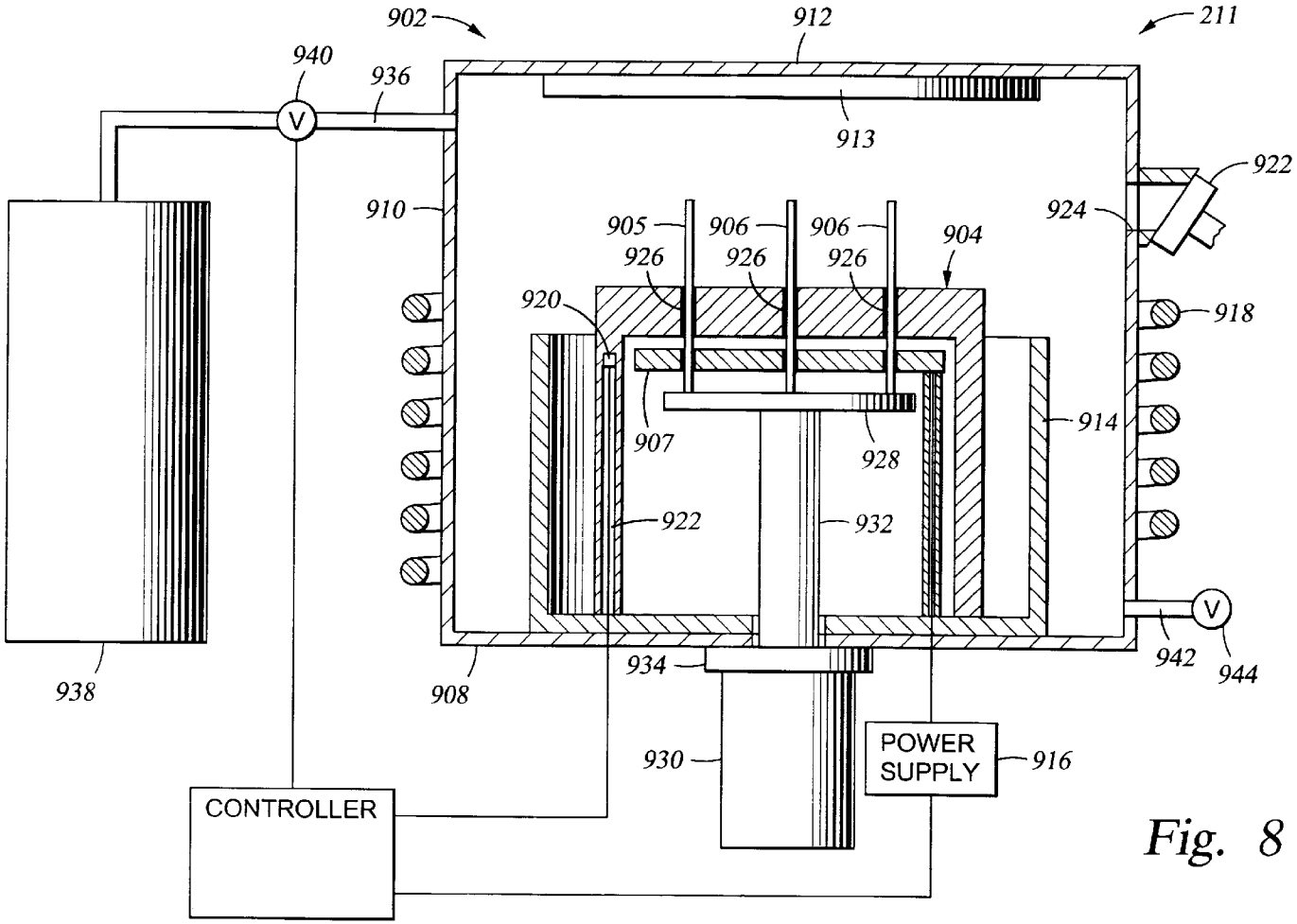
FIG. 8 is a cross sectional view of one embodiment of a rapid thermal anneal chamber.

FIG. 8 is a cross sectional view of an embodiment of rapid thermal anneal (RTA) chamber. The RTA chamber 211 is preferably connected to the loading station 210, and substrates are transferred into and out of the RTA chamber 211 by the loading station transfer robot 228. The ECP system, as shown in FIGS. 2 and 3, preferably comprises two RTA chambers 211 disposed on opposing sides of the loading station 210, corresponding to the symmetric design of the loading station 210. RTA chambers are generally well known in the art, and RTA chambers are typically utilized in substrate processing systems to enhance the properties of the deposited materials. A variety of RTA chamber designs, including hot plate designs and heat lamp designs, may be used to enhance the electroplating results. One RTA chamber is the WxZ chamber available from Applied materials, Inc., located in Santa Clara, Calif. Although this disclosure is described using a hot plate RTA chamber, other types of RTA chambers may be used as well.

Referring back to FIG. 2, the FCP system 200 includes the controller 222 that controls the functions of each component of the platform. Preferably, the controller 222 is mounted above the mainframe 214, and the controller comprises a programmable microprocessor. The programmable microprocessor is typically programmed using a software designed specifically for controlling all components of the ECP system 200. The controller 222 also provides electrical power to the components of the system and includes a control panel 223 that allows an operator to monitor and operate the ECP system 200. The control panel 223, as shown in FIG. 2, is a stand-alone module that is connected to the controller 222 through a cable and provides easy access to an operator. Generally, the controller 222 coordinates the operations of the loading station 210, the RTA chamber 211, the SRD station 212, the mainframe 214 and the processing stations 218. Additionally, the controller 222 coordinates with the controller of the electrolyte solution replenishing system 220 to provide the electrolyte solution for the electroplating process.

One embodiment of typical substrate electroplating process sequence through the electroplating system platform 200 is described relative to FIG. 2. A substrate cassette containing a plurality of substrates is loaded into the substrate cassette receiving areas 224 in the loading station 210 of the electroplating system platform 200. A loading station transfer robot 228 picks up a substrate from a substrate slot in the substrate cassette and places the substrate in the substrate orientor 230. The substrate orientor 230 determines and orients the substrate to a desired orientation for processing through the system. The loading station transfer robot 228 then transfers the oriented substrate from the substrate orientor 230 and positions the substrate in one of the substrate slots in the substrate pass-through cassette 238 in the SRD station 212. The mainframe transfer robot 242 picks up the substrate from the substrate pass-through cassette 238 and positions the substrate for transfer by the flipper robot 248. The flipper robot 248 rotates its robot blade below the substrate and picks up substrate from mainframe transfer robot blade. The vacuum suction gripper on the flipper robot blade secures the substrate on the flipper robot blade, and the flipper robot flips the substrate from a face up position to a face down position. The flipper robot 248 rotates and positions the substrate face down in the substrate holder assembly 450. The substrate is positioned below the substrate holder plate 464 but above the cathode contact ring 466. The flipper robot 248 then releases the substrate to position the substrate into the cathode contact ring 466. The substrate holder plate 464 moves toward the substrate and the vacuum chuck secures the substrate on the substrate holder plate 464. The bladder assembly 470 on the substrate holder assembly 450 exerts pressure against the substrate backside to ensure electrical contact between the substrate plating surface and the cathode contact ring 466.

The head assembly 452 is lowered to a processing position above the electrolyte cell 420. At this position the substrate is below the upper plane of the weir 478 and contacts the electrolyte solution contained in the electrolyte cell 420. The power supply is activated to supply electrical power, i.e., voltage and current, to the cathode and the anode to enable the electroplating process. The electrolyte solution is typically continually pumped into the process cell during the electroplating process. The electrical power supplied to the cathode and the anode and the flow of the electrolyte solution are controlled by the controller 222 to achieve the desired electroplating results. Preferably, the head assembly is rotated as the head assembly is lowered and also during the electroplating process.

After the electroplating process is completed, the head assembly 410 raises the substrate holder assembly and removes the substrate from the electrolyte solution. Preferably, the head assembly is rotated for a period of time to enhance removal of residual electrolyte solution from the substrate holder assembly. The vacuum chuck and the bladder assembly of the substrate holder assembly then release the substrate from the substrate holder plate. The substrate holder assembly is raised to allow the flipper robot blade to pick up the processed substrate from the cathode contact ring. The flipper robot rotates the flipper robot blade above the backside of the processed substrate in the cathode contact ring and picks up the substrate using the vacuum suction gripper on the flipper robot blade. The flipper robot rotates the flipper robot blade with the substrate out of the substrate holder assembly, flips the substrate from a face-down position to a face-up position, and positions the substrate on the mainframe transfer robot blade. The mainframe transfer robot then transfers and positions the processed substrate above the SRD module 236. The SRD substrate support lifts the substrate, and the mainframe transfer robot blade retracts away from the SRD module 236. The substrate is cleaned in the SRD module using deionized water or a combination of deionized water and a cleaning fluid as described in detail above. The substrate is then positioned for transfer out of the SRD module. The loading station transfer robot 228 picks up the substrate from the SRD module 236 and transfers the processed substrate into the RTA chamber 211 for an anneal treatment process to enhance the properties of the deposited materials. The annealed substrate is then transferred out of the RTA chamber 211 by the loading station robot 228 and placed back into the substrate cassette for removal from the ECP system. The above-described sequence can be carried out for a plurality of substrates substantially simultaneously in the ECP system 200. Also, the ECP system can be adapted to provide multi-stack substrate processing.

Coated Anode Configuration

Two embodiments of coated anodes for an ECP system are shown in FIGS. 18 and 19. These coated anodes are configured to provide a planar anode surface that faces toward the substrate seed layer is coated with a chemically inert material. The inert characteristics of the planar surface maintains the planar surface configuration. The coated planar surface in the embodiments shown in FIGS. 18 and 19 are spaced substantially parallel to the substrate seed layer surface. Since the planar anode electric field generating surface is parallel to the seed layer, each point on the seed layer is spaced a uniform distance from the nearest point on the planar anode electric field generating surface through the electrolyte solution. This uniformity of distances from the seed layer to the electric field generating surface results in an enhanced uniformity of electric current density across the seed layer. Such uniformity of electric current density across the seed layer results in enhanced uniformity of metal film deposition rate across the seed layer during plating and an enhanced uniformity to the resultant metal film plating depth across the seed layer following the plating process.

In a one embodiment of ECP system partially shown in FIG. 18, the anode assembly 2606 comprises an anode body 2608 and an anode coating 2610. The anode body 2608 is preferably a solid piece of copper, preferably, high purity and oxygen free. The anode coating 2610 is coated on the upper surface of the anode body 2608, prior to the insertion of the anode in the electrolyte solution for plating purposes, to limit the electrolyte solution from physically contacting (and thus chemically reacting with) the upper surface of the anode body. As such, the anode coating maintains the structure and shape of the anode body 2608 during the extended operation of the anode. To form the anode coating 2610, the surface of the anode body (or a portion of the anode body) that is directed toward the seed layer on the substrate is coated with a material, such as tantalum, that is chemically inert to the electrolyte solution. The anode coating 2610 thus allows the coated upper surface 2619 of the anode body 2608 to resist chemical degradation and remain substantially planar during the anode's useful lifetime.

The chemically inert material that coats the anode is selected to limit any physical alteration of the coated upper surface 2619 resulting from the electro-chemical interaction between the anode and the electrolyte solution. The embodiment of ECP system shown in FIG. 18 includes an electrolyte cell 2602 that contains an electrolyte solution, a substrate holder system 14 including a substrate holder assembly 2604, and an anode assembly 2606. The substrate holder assembly 2604 is configured to insert a substrate 22 into, or remove a substrate 22 from, the electrolyte solution contained in the electrolyte cell. The anode assembly 2606 is located within the electrolyte solution contained in the electrolyte cell 2602 during plating operations.

The anode assembly 2606 includes an anode body 2608 formed from copper or another metal for generating metal ions, an anode coating 2610 that is coated on the surface of the anode body 2608 facing the substrate 22, one or more electric feed-throughs 294 that act to support the anode, and also provide an electric current/voltage to the anode body 2608, and preferably, perforations 2612 that extend through the anode body 2608 and the anode coating 2610. The anode assembly 2606 is configured to chemically react with the electrolyte solution contained within the electrolyte cell 2602 to release metal ions, e.g., copper ions, into the electrolyte solution. The metal ions within the electrolyte solution are transported by a combination of the electrolyte solution flow and/or the electric field established between the anode assembly 2606 and the substrate 22 to a position adjacent the lower surface of the substrate.

The anode body 2608 in the embodiment shown in FIG. 18 is configured with vertical flow perforations 2612 that permit flow of electrolyte solution through the anode. The perforations allow for a more uniform fluid flow of electrolyte solution through the anode body 2608 to the seed layer across the width of the electrolyte cell. In another embodiment of ECP system, no perforations 2612 are provided through the anode body 2608 and anode coating 2610. In the embodiment of ECP system excluding perforations, the distance Z between the upper surface 2619 of the anode body 2608 and the seed layer 15 on the substrate 22 has to be sufficient so that metal ions flowing within the electrolyte solution around the sides 2622 of the anode to the seed layer 15 on the substrate will diffuse within the electrolyte solution to be substantially uniform across the seed layer as the metal ions flow to the seed layer. The substrate holder 2604 may rotate the substrate in certain embodiments, as described relative to FIG. 15. This rotation may enhance the uniformity of the metal film deposition process on the seed layer on the substrate since no portion of the seed layer is in continual contact with any one specific electrolyte solution location. Certain embodiments of the substrate holder assembly 2604 do not provide this substrate rotation.

The upper surface or the electric field generating surface 2619 of the anode body 2608, shown in the embodiments shown in FIG. 18, does not chemically react with the electrolyte solution because the inert coating is limiting the physical contact of the anode base with the electrolyte solution. The chemical reaction between the upper surface 2619 of the anode body 2608 and the electrolyte solution therefore is negligible. Another source of metal ions may be supplied to the electrolyte solution. In one embodiment, higher levels of copper ions than are normally generated by interaction between the upper surface 2619 of the anode body 2608 and the electrolyte solution can be provided by increasing the metal ions with the recirculation/refreshing clement 287. In another embodiment, the anode body 2608 can be configured to provide additional copper ion generation by increasing the area or some other reaction rate factor of the lower or side surfaces of the anode that reacts with the electrolyte solution. Alternatively, a distinct metal ion generating anode can be provided as a separate unit that is located below, and thus further from the seed layer than the electric field generating anode. The controller 222 can provide an increased electrical/voltage bias between the anode body 2608 and the seed layer to enhance the plating action on the seed layer on the substrate since plating action is a function of voltage.

Though other portions of the anode body 2608 degrade from contact or chemical interaction with the electrolyte solution to release metal ions into the electrolyte solution during the plating process, the upper surface 2619 of the anode body 2608 is protected against such degradation by the anode coating 2610. Since the anode coating 2610 limits physical contact of and chemical reaction with, electrolyte solution with the upper surface of the anode body, any degradation of the upper surface of the anode body is reduced or eliminated. Since the anode body does not degrade, the vertical distance of all locations between the substrate seed layer and the upper surface 2619 of the anode body 2608 remain consistent as shown by arrow Z. Since all points along the upper surface 2619 of the anode body 2608 are maintained substantially equally spaced from the nearest location on the substrate seed layer 15 by distance Z when the upper surface is planar, the resistance of the electrolyte solution between all points of the seed layer 15 and the upper surface 2619 of the anode body 2608 remains substantially uniform (since the electric characteristics of the electrolyte solution are assumed homogeneous, and therefore the electric resistance of the electrolyte solution varies based on Ohm's Law). Since the resistance of the electrolyte solution between the seed layer and the anode is substantially uniform about the surface of the seed layer, the electric current density on the seed layer is also substantially uniform across the seed layer. This substantially uniform current density results in an enhanced uniformity of metal film deposition on the substrate.

The chemical reaction that occurs in one embodiment of ECP system shown in the embodiments in FIGS. 4, 18, and 19 may be characterized by whether a positive voltage bias, or negative voltage bias, is applied between the anode and the seed layer, to respectively effect a plating metal film, or a deplating of the metal film, on the substrate. If a sufficient positive bias is applied so that the voltage of the seed layer is below (i.e., more negative) the level of the voltage of the anode, metal ions are plated onto the seed layer on the substrate. If a sufficient negative bias is applied so that the voltage of the seed layer exceeds (i.e. more positive) the voltage of the anode by a sufficient level, copper is deplated from the seed layer.

The anode assembly 2606 may be enclosed in a hydrophilic membrane 289. As the electrolyte flows through the hydrophilic membrane 289, particulates and other matter generated, by the chemical reaction between the anode and the electrolyte solution are filtered or trapped by the encapsulation membrane. In the embodiment of anode body 2608 shown in FIG. 18, the electrolyte solution primarily chemically reacts with the backside, edge, and the inner walls of the perforations, of the anode body 2608. Hydrophilic membrane 289 is position to allow electrolyte solution and metal ions to pass through the membrane that surrounds the anode assembly 2606. The hydrophilic membrane 289 may form a filter in the form of a membrane basket to filter out certain particular matter from the electrolyte solution. Hydrophilic membrane 289, in another embodiment, is held by brackets to extend generally across the electrolyte cell parallel to, and closely spaced above, the anode (e.g., about half a centimeter or more).

Preferably, the hydrophilic membrane 289 comprises a hydrophilic porous membrane, such as a modified polyvinyidene fluoride membrane, having porosity between about 60% and 80%, more preferably about 70%, and pore sizes between about 0.025 $\mu$m and about 1 $\mu$m, more preferably between about 0.1 $\mu$m and about 0.2 $\mu$m. One example of a hydrophilic membrane 289 is the Durapore Hydrophilic Membrane, available from Millipore Corporation, located in Bedford, Mass.

A flow diffuser 71 may be provided across the inner surfaces of the electrolyte cell. Electrolyte solution flows through pores of the flow diffuser with sufficient difficulty so a slight pressure differential may be provided in the electrolyte solution across the width of the flow diffuser. The flow diffuser may be clamped, clipped, secured by fasteners or adhesive, or attached in any known suitable manner to the inner surface of the electrolyte cell 2602. The flow diffuser 71 is intended to provide a substantially uniform vertical flow velocity of the electrolyte solution across the width of the electrolyte cell above the flow diffuser. The dimensions and number of the pores and the material of the flow diffuser are selected based on the chemical constituency and particle size of the electrolyte solution and the metal ions. The anode assembly 2606 acts to maintain the electric field generating surface 2619 substantially planar on the face of the anode body 2608 that is coated by the anode coating 2610. The planar electric field generating surface 2619 is provided to face the substrate 22.

The purpose of maintaining the electric field generating surface 2619 during the plating process is to ensure that the distance from each point on the electric field generating surface to its closest point to the seed layer on the substrate 22 is substantially uniform across the surface of the anode body 2608. Any difference in distance between the electric field generating surface 2619 of the anode body 2608 and the closest point on the substrate seed layer 22 is reflected by a variation in resistance between the different points on the electric field generating surface and their corresponding closest point on the substrate seed layer. This variation of resistance through electrolyte solution results since resistance of the electrolyte solution, as well as other liquids, varies according to distance that an electric current has to flow through that medium as is reflected by Ohms law.

By applying the chemically inert anode coating 2610 to portions of the anode body, the electrolyte solution does not contact the anode body 2608 at those coated locations that are configured to correspond to its electric field generating surface 2619. Such limiting of contact between the electrolyte solution and the electric field generating surface 2619 limits the generation of metal ions by the electrochemical reaction into the electrolyte solution at the electric field generating surface. Since the anode coating 2610 limits a chemical reaction between the electrolyte solution and the electric field generating surface 2619, no metal ions are generated from the electric field generating surface. Additionally, the electric field generating surface will maintain a substantially level contour due to its limiting contact with the electrolyte solution.

The application of the anode coating 2610 in the anode assembly 2606 in the embodiment shown in FIG. 18 ensures that the electric field generating surface remains substantially planar after extended plating use, and thereby enhances the uniformity of the electric field generated between the anode assembly 2606 and the substrate 22 and enhances uniformity of electric current density across the surface of the seed layer on the substrate 22. Such uniformity of electric current density to the plating surface results in a more uniform distribution of the metal ions from the electrolyte solution on the substrate seed layer across the width of the electrolyte cell 2602.

The dimensions of the perforations 2612 are preferably minimized to limit any aberration to the uniformity of the electric field that is applied to the lower surface of the substrate. The inner surfaces of the perforations are, in certain embodiments, coated to limit chemical reaction with the electrolyte solution. In other embodiments, the perforations remain uncoated. In those embodiments where the perforations are uncoated, it is important to ensure that the width dimensions of the perforations remain within dimensions, during normal use, to a level where no electric field aberrations from the anode are applied to the lower surface of the substrate.

Increasing the concentration of the metal ions above one side of the anode assembly 2606, for example, might increase the metal film deposition on the substrate seed layer on that side of the electrolyte cell. As such, perforations 2612 extend substantially vertically through the anode body 2608 and the anode coating 2610 to allow the electrolyte solution to flow upwardly through portions of the perforations. One prior perforated anode configuration is described in U.S. application Ser. No. 09/534,951 to Dordi, entitled "PERFORATED ANODE FOR UNIFORM DEPOSITION OF A METAL LAYER", and filed Mar. 24, 2000 (incorporated herein by reference). The perforations 2612 are preferably distributed substantially evenly across the surface area of the anode body 2608. For example, these perforations may be spaced every sixteenth of an inch to every inch, in a grid like perforated anode configuration, to allow electrolyte solution to flow vertically upward through the anode body.

The perforations 2612 are intended to enhance the uniformity of these chemical reactions across the electrolyte solution contained in the electrolyte cell 2602 above the anode assembly 2606. It may be desired to modify the perforations in a maimer to enhance the chemical reactions between the electrolyte solution and the anode if it is found that fewer metal ions are produced when the upper surface of the anode is coated. For example, assuming that fewer metal ions are generated above the center portions of the anode body 2608 compared to the peripheral portions the number or size of perforations 2612 may be increased in the center portions of the anode body 2608 corresponding to those locations where the reduced metal ion generations occur.

In one embodiment of ECP system, the perforations through the anode body 2608 do not contain any anode coating, and as such, as the electrolyte solutions travel vertically upward in the perforations, those portions of the surface area of the anode body that forms the surface of the perforations chemically react with the electrolyte solution flowing upward through the perforations. While a perforated anode is utilized in the embodiment in FIG. 18, it is envisioned that a solid copper anode may also be utilized. If a solid anode is provided, some mechanism may be provided to achieve uniformity of metal ions in the electrolyte solution in the electrolyte cell. Such mechanisms may include, but are not limited to, increasing the distance between the anode and the seed layer containing the electrolyte solution through which the metal ions flow. This increased distance allows the concentration of metal ions across the seed layer to become more uniform across the width of the electrolyte cell by diffusion. Vanes, baffles, or other similar fluid flow deflectors (not shown) may be provided in the electrolyte cell to cause a mixing of the metal ions in the electrolyte solution across the width of the electrolyte cell as the electrolyte solution flows upwardly.

The electrolyte cell can be configured so the distance between the anode and the seed layer is sufficiently large so the metal ions mix to become substantially uniform across the width of the electrolyte cell by diffusion. Combinations of these mixing techniques to enhance the uniformity of metal ions across the electrolyte cell are within the intended scope of elements to be used in combination with the coated anode. The chemical reaction between the anode and the electrolyte solution releases metal ions, e.g. copper ions, into the electrolyte solution. A similar chemical reaction can occur between the anode body 2608 and the electrolyte solution along the lower surfaces 2621, and the side surfaces 2622 of the anode body 2608.

Considering FIG. 18, the anode assembly 2606 is configured to provide a uniform electrolyte solution fluid flow, a substantially level planar electric field generating surface 2619, a uniform metal film deposition process on the seed layer, and an adequate release of metal ions from the anode, all action therewith of the electrolyte cell 2602. The anode coating also limits the chemical reaction of the electric field generating surface 2619 with the electrolyte cell 2602. The effect of this limited chemical reaction, which maintains a more planar electric field generating surface 2619, is to enhance the uniformity of electric current density on the seed layer on the substrate 22, and therefore enhances the uniformity of metal film deposition across the surface of the substrate seed layer.

FIG. 19 shows an alternate embodiment of ECP system 2700 in which the anode is subdivided into two distinct anode components. One anode component is referred to as a "metal ion generating anode", and is related to generating metal ions and, in one embodiment, generating an electric field to the electrolyte solution. The other anode component is related to enhancing the uniformity of the electric field within the electrolyte solution as applied to the seed layer across the lower surface of the substrate. The ECP system 2700 comprises a substrate holder 2604, a substrate 22 (seed layer facing downward), an electrolyte cell 2602 which is configured to contain electrolyte solution therein, a coated electric field uniformity enhancing anode 2706, and a metal ion generating anode 2710. The metal ion generating anode 2710 acts to generate metal ions by a chemical reaction with the electrolyte solution. Preferably, the metal ions are substantially uniformly distributed across the width of the electrolyte cell 2602. The metal ion generating anode 2710 includes an anode body 2710 and a plurality of electric feed throughs 2712. An electric current/voltage is applied to the electric feed throughs 2712 in such a manner that the electric field generating anode 2710 generates metal ions into the electrolyte solution contained in the electrolyte cell 2602.

For this alternative embodiment, the anode body 2710 of the metal ion generating anode 2710 may be configured as solid copper anode, a solid copper anode with perforations, an anode with one or more coated surfaces or other anode body configurations. The electric field uniformity enhancing anode 2706 acts to provide a substantially uniform electric field across the width of the electrolyte cell 2602 within the electrolyte solution. This substantially uniform electric field across the width of the electrolyte cell 2602 acts to enhance uniformity of the electric current density applied to the seed layer on the substrate 22 during plating operations. Enhancing the uniformity of the electric current density across the seed layer, i.e., from the center of the seed layer to the periphery of the seed layer, also enhances the uniformity of the metal film deposition rate across the seed layer.

The coated electric field uniformity enhancing anode 2706 includes an electric conductive core 2720, a chemically inert coating 2722, and an upper electric feed through 2724 as configured with appropriate support members to maintain the electric field uniformity enhancing anode 2706 in position centered above the metal ion generating anode 2710. The electric conductive core 2720 may be formed of such material as aluminum, copper, or other electrically conductive material. The electric conductive core 2720 is surrounded and sealed against the electrolyte solution by the inert coating 2722. The inert coating 2722 may be formed from inert compounds or alloys such as Ta, TaN, or alternatively may be formed by some inert plastic material that provides a sealing capability for the electric conductive core 2720 against the electrolyte solution, without substantially diminishing the electric field generating capabilities of the electric field uniformity enhancing anode 2706.

The upper electric feedthrough 2724 may extend through the side of the electrolyte cell 2602 and be disposed in electrical communication with the electric conductive core 2720 to supply the electric current/voltage, as desired, to the electric conductive core 2720. The upper electric feed through 2724 is also sealed to limit chemical reaction of the electric conductive element with the electrolyte solution contained in the electrolyte cell. The flow through apertures 2726 extend through the electric field uniformity enhancing anode 2706 to allow the electrolyte solution and/or the metal ions contained in the electrolyte solution to flow upwardly from below the electric field uniformity enhancing anode 2706 to above the electric field uniformity enhancing anode 2706.

The dimensions of the flow through apertures 2726 are preferably minimized to limit any aberration to the uniformity of the electric field that is applied to the lower surface of the substrate. The inner surfaces of the flow through apertures 2726 are, in certain embodiments, coated to limit chemical reaction with the electrolyte solution. In other embodiments, the perforations remain uncoated. In those embodiments where the flow through apertures 2726 are uncoated, it is important to ensure that the width dimensions of the flow through apertures remain within dimensions, during normal use, to a level where no electric field aberrations from the anode are applied to the lower surface of the substrate as a result of the flow through apertures.

Since the metal ion generating anode 2710 is located further from the seed layer than the electric field uniformity enhancing anode 2706, the electric effects to the generated electric current density levels across the seed layer 15 are dominated by the electric field uniformity enhancing anode 2706 rather than the metal ion generating anode 2710. As such, maintaining a substantially planar upper surface 2723 of the electric conductive core 2720 is the dominant anode consideration between anodes 2706 and 2710 in enhancing uniformity of the electric current density across the seed layer. It is therefore important during plating operations to ensure that the electric current/voltage levels applied via the electric feed throughs 2712 to the metal ion generating anode 2710 do not exceed the electric current/voltage levels applied via the electric feed throughs 2724 to the electric field generating anode 2706 by an amount so that the effect on the generated electric current density across the seed layer is more pronounced by the electric field uniformity enhancing anode 2706 than the metal ion generating anode 2710. The vertical distance between the anodes 2706 and 2710 can be increased to limit the electric current density effect on anode resulting from the electric current/voltage levels of the metal ion generating anode 2710.

The apertures 2726 in the electric field uniformity enhancing anode 2706 may be configured in a grid like pattern, wherein each of the flow through apertures 2726 is sized so as not to substantially limit the upward flow of the electrolyte solution containing the metal ions therethrough. As such, the diameter of apertures 2726 may vary from about a sixteenth of an inch and above. The inert metal coating 2720 may be coated on any of the upper anode surface, the lower anode surface, and/or the surfaces of the flow through apertures 2726 in effect to seal the material of the electric conductive core 2720 against the electrolyte solution flowing through them.

The upper surface of the electric conductive core 2720 is selected to be substantially planer and parallel to the seed layer on the substrate so that the distance from each point on the seed layer on the substrate 22 to its nearest location on the upper surface of the electric conductive core 2720 is substantially constant. Such uniformity of distances enhances the uniformity of electric current density generated across to the substrate seed layer from center to periphery. Additionally, maintaining the substantially level upper surface of the electric conductive core 2720 by limiting the chemical reaction between the upper surface and the electrolyte solution enhances the uniformity of the deposition rate of the metal film across the substrate seed layer since metal film deposition rate is a function of electric current density at the seed layer. Since the electric conductive core 2720 is sealed against contact with the electrolyte solution by the inert coating 2722, a substantially level upper surface is maintained throughout the useful life of the electric field uniformity enhancing anode 2706.

The anode body 2710 of the metal ion generating anode 2710 generates metal ions substantially uniformly across the width of the electrolyte cell 2602. These metal ions are transported upwardly in the electrolyte cell from the metal ion generating anode 2710 toward the substrate 22 using a combination of mechanisms, including the electric field established between the metal ion generating anode 2710 and the seed layer on the substrate 22, as well as generally upward flow of the electrolyte solution within the electrolyte cell 2602. The metal ion and the electrolyte solution flow upwardly through the flow through apertures 2726 in the electric field uniformity enhancing anode 2706. The electric field lines generated by the electric field uniformity enhancing anode 2706 extends substantially upward from the electric field uniformity enhancing anode to the seed layer on the substrate. Ideally, the electrolyte cell 2602 the electric field uniformity enhancing anode 2706, and the seed layer on the substrate 22 are configured so that the electric lines of the electric field extending from the electric field uniformity enhancing anode 2706 to the substrate seed layer are substantially parallel. Such substantially parallel electric field lines from the electric field uniformity enhancing anode 2706 to the seed layer on the substrate 22 enhance the uniformity of the metal ions available across the seed layer on the substrate 22. As such, the metal ion generating anode 2706 generates the metal ions into the electrolyte solution in the electrolyte cell substantially uniformly across the width of the electrolyte cell 2602, and the electric field uniformity enhancing anode 2706 acts to maintain this uniformity of metal ion distribution across the width of the electrolyte solution contained in the electrolyte cell until such times as the metal ions in the electrolyte solution deposits onto the seed layer on the substrate.

Although various embodiments that incorporate the teachings of the present invention have been shown and described in detail herein, those skilled in the art can readily devise many other varied embodiments that still incorporate these teachings.

What is claimed is:

1. An anode assembly for a plating apparatus, comprising:

an anode having an electric field generating portion and an electrolyte solution chemical reaction portion, the electric field generating portion comprising an inert material.

2. The anode assembly of claim 1, wherein the electric field generating portion acts to generate a substantially uniform electric field across a substrate being plated.

3. The anode assembly of claim 1, wherein the inert material includes one or more metals from the group of tantalum, titanium, and tungsten.

4. The anode assembly of claim 1, wherein the substantially electric field generating portion of the anode includes a planar surface coated with the inert material, the planar surface is oriented substantially parallel to a seed layer on a substrate, the seed layer and the anode being both immersed in an electrolyte solution.

5. The anode assembly of claim 1, wherein the electrolyte solution chemical reaction portion chemically reacts with an electrolyte solution to generate metal ions in the electrolyte solution.

6. The anode assembly of claim 1, wherein the electric field generating portion and the electrolyte solution chemical reaction portion are formed on distinct elements.

7. The anode assembly of claim 1, further comprising a filter positioned proximate the anode, wherein the filter is a membrane filter.

8. The anode assembly of claim 7, wherein the filter limits particle generation by the anode into the electrolyte solution.

9. The anode assembly of claim 1, wherein the anode includes perforations that extend through the anode assembly.

10. The anode assembly of claim 9, wherein the perforations include surfaces for reacting with electrolyte solution flowing through the perforations.

11. The anode assembly of claim 1, wherein the electric field generating portion and the electrolyte Solution chemical reaction portion are formed on a contiguous element.

12. The anode assembly of claim 1, wherein the electric field generating portion is structurally distinct from the electrolyte solution chemical reaction portion.

13. An electrochemical plating system configured to receive a substrate and deposit a metal film on a seed layer on the substrate, the electro-chemical plating system comprising:

an anode having a substantially planar electric field generating portion and an electrolyte solution chemical reaction portion, the electric field generating portion comprising an inert material; and an electrolyte cell.

14. The electrochemical plating system of claim 13, wherein the electric field generating portion is substantially planar and is oriented to be substantially parallel to the seed layer on the substrate.

15. The electrochemical plating system of claim 13, wherein the inert material is an inert metal.

16. The electro-chemical plating system of claim 15, wherein the inert metal includes one or more metals from the group of tantalum, titanium, and tungsten.

17. The electrochemical plating system of claim 13, wherein the substantially planar electric field generating portion of the anode includes a planar surface coated with the inert material, the planar surface is oriented substantially parallel to a seed layer on a substrate, the seed layer and the anode being both immersed in an electrolyte solution.

18. The electro-chemical plating system of claim 13, wherein the electrolyte solution chemical reaction portion chemically reacts with an electrolyte solution to generate metal ions in the electrolyte solution.

19. The electrochemical plating system of claim 13, wherein the planar electric field generating portion and the electrolyte solution chemical reaction portion are formed on distinct elements.

20. The electro-chemical plating system of claim 13, further comprising a filter positioned proximate the anode, wherein the filter is a membrane filter.

21. The electro-chemical plating system of claim 20, wherein the filter limits particle generation by the anode into the electrolyte solution.

22. The electro-chemical plating system of claim 13, wherein the anode includes perforations that extend through the anode.

23. The electro-chemical plating system of claim 22, wherein the perforations include surfaces for reacting with electrolyte solution flowing through the perforations.

24. The electrochemical plating system of claim 22, wherein the planar electric field generating portion and the electrolyte solution chemical reaction portion are formed on a contiguous element.

25. The electro-chemical plating system of claim 13, wherein the planar electric field generating portion is structurally distinct from the electrolyte solution chemical reaction portion.

26. A method to deposit a metal film on a seed layer on a substrate using an anode, the method comprising:

immersing a coated anode in an electrolyte solution, the coated anode comprising a substantially planar electric field generating portion and an electrolyte solution chemical reaction portion, the planar electric field generating portion comprising an inert material;

immersing the seed layer in the electrolyte solution; and applying a voltage between the anode and the seed layer.

27. The method of claim 26 wherein the seed layer is immersed in the electrolyte solution to a position so the seed layer is substantially parallel to the substantially planar electric field generating portion.

* * * * *

UNITED STATES PATENT AND TRADEMARK OFFICE

CERTIFICATE OF CORRECTION

PATENT NO. : 6,576,110 B2
DATED : June 10, 2003
INVENTOR(S) : Dan Maydan

It is certified that error appears in the above-identified patent and that said Letters Patent is hereby corrected as shown below:

Column 1,
Line 43, please change “chemically)” to -- chemically --.

Column 2,
Line 15, please change “establishing,a” to -- establishing a --.

Column 3,
Line 14, please change “contact” to -- contact ring; --
Line 57, please change “ale” to -- are --.

Column 4,
Line 24, please change “2 18” to -- 218 --.

Column 6,
Lines 12-13, please add line 13 to the end of line 12 to make one paragraph.

Column 7,
Line 33, please change “Shoulder” to -- shoulder --.
Line 52, please change “polyviniylidenefluoride” to -- polyvinylidenefluoride --.

Column 8,
Line 19, please change “III” to -- an --.

Column 10,
Line 17, please change “Such” to -- such --.
Line 45, please change “Surfaces” to -- surfaces --.

Column 12,
Line 48, please change “Surface” to -- surface --.
Line 65, please change “arc” to -- are --.

Column 13,
Line 33, please change “;s” to -- as --.

Column 14,
Line 32, please change “hew” to -- new --.

Column 19,
Line 12, please change “With” to -- with --.

UNITED STATES PATENT AND TRADEMARK OFFICE

CERTIFICATE OF CORRECTION

PATENT NO. : 6,576,110 B2 
DATED : June 10, 2003
INVENTOR(S) : Dan Maydan

It is certified that error appears in the above-identified patent and that said Letters Patent is hereby corrected as shown below:

Column 20,
Line 10, please change "FCP" to -- ECP --.

Column 23,
Line 21, please change "clement" to -- element --.

Column 29,
Line 63, please change "Solution" to -- solution --.

Column 30,
Lines 19, 29 and 45, please change "electrochemical" to -- electro-chemcial --.

Signed and Sealed this

Ninth Day of December, 2003

JAMES E. ROGAN
*Director of the United States Patent and Trademark Office*